US011183114B2

(12) United States Patent
Li et al.

(10) Patent No.: US 11,183,114 B2
(45) Date of Patent: Nov. 23, 2021

(54) DISPLAY PANEL, COMPENSATION METHOD THEREOF AND DISPLAY DEVICE COMPENSATING AN ORGANIC LIGHT-EMITTING ELEMENT

(71) Applicant: Shanghai Tianma AM-OLED Co., Ltd., Shanghai (CN)

(72) Inventors: Yue Li, Shanghai (CN); Xingyao Zhou, Shanghai (CN); Shuai Yang, Shanghai (CN); Mengmeng Zhang, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/852,166

(22) Filed: Apr. 17, 2020

(65) Prior Publication Data

US 2020/0243005 A1 Jul. 30, 2020

(30) Foreign Application Priority Data

Nov. 28, 2019 (CN) ..... 201911195371.9

(51) Int. Cl.
*G09G 3/3225* (2016.01)

(52) U.S. Cl.
CPC ... *G09G 3/3225* (2013.01); *G09G 2310/0286* (2013.01); *G09G 2320/0233* (2013.01)

(58) Field of Classification Search
CPC ..... G09G 3/3225; G09G 3/3233; G09G 2300/0819; G09G 2300/0861;
(Continued)

(56) References Cited

U.S. PATENT DOCUMENTS

2014/0347332 A1* 11/2014 Lee ..... G09G 3/3233 345/204
2017/0032738 A1* 2/2017 Lee ..... G09G 3/3233
(Continued)

FOREIGN PATENT DOCUMENTS

CN 101546056 A 9/2009
CN 102338958 A 2/2012
(Continued)

*Primary Examiner* — Kwang-Su Yang
(74) *Attorney, Agent, or Firm* — Alston & Bird LLP

(57) ABSTRACT

Provided are a display panel, a compensation method thereof and a display device. The display panel includes an organic light-emitting element array, a pixel circuit and a detection circuit; the organic light-emitting element array includes multiple organic light-emitting element groups, and $i^{th}$ organic light-emitting element rows in each organic light-emitting element groups are adjacently arranged; a peripheral circuit region includes a pixel driving circuit, a detection driving circuit, and an integrated driving circuit; in a detection phase, the detection driving circuit provides an enabling signal to the detection circuit; the integrated driving circuit provides a detection signal for the detection circuit, and sequentially detects multiple organic light-emitting element groups in a same organic light-emitting element row; in a display phase, the integrated driving circuit provides the compensation signal to the pixel circuit according to the compensation signal.

9 Claims, 13 Drawing Sheets

(58) Field of Classification Search
CPC ... G09G 2310/0286; G09G 2300/0842; G09G 2320/0233; G09G 2320/0295
See application file for complete search history.

(56) References Cited

U.S. PATENT DOCUMENTS

| | | | | |
|---|---|---|---|---|
| 2017/0206839 | A1* | 7/2017 | Wu | G09G 3/3233 |
| 2019/0035334 | A1* | 1/2019 | Lin | G09G 3/3258 |

FOREIGN PATENT DOCUMENTS

| | | | |
|---|---|---|---|
| CN | 206194295 | U | 5/2017 |
| CN | 107025884 | A | 8/2017 |
| CN | 110473501 | A | 11/2019 |

* cited by examiner

DISPLAY PANEL, COMPENSATION METHOD THEREOF AND DISPLAY DEVICE COMPENSATING AN ORGANIC LIGHT-EMITTING ELEMENT

CROSS-REFERENCE TO RELATED APPLICATION

This application claims priority to Chinese patent application No. CN201911195371.9, filed with the Patent Office of the People's Republic of China on Nov. 28, 2019, the content of which is incorporated herein by reference in its entirety.

TECHNICAL FIELD

The present disclosure relates to the field of display technologies and, in particular, to a display panel, a display device and a compensation method thereof.

BACKGROUND

As a current type light-emitting element, an Organic Light-Emitting Diode (OLED) has the advantages of self-luminescence, quick response, a wide viewing angle, and being manufacturable on a flexible substrate, therefore OLEDs are widely applied to the field of high performance display. Since the OLED is a current-driven display, the aging of the OLED is accelerated as use time increases, and therefore, brightness uniformity of a screen in a OLED display is a great difficulty in product development, and particularly, the brightness uniformity is serious in the existing large-size AMOLED display.

SUMMARY

The present disclosure provides a display panel, a compensation method thereof, and a display device, in which the display uniformity of the display panel is improved by compensating an organic light-emitting element.

In one aspect, an embodiment of the present disclosure provides a display panel including a display region and a peripheral circuit region surrounding the display region.

The display region includes: an organic light-emitting element array comprising a plurality of organic light-emitting element groups, each comprising a plurality of organic light-emitting element columns arranged in parallel and numbered as $i^{th}$, where i is an integer larger than 1, $i^{th}$ organic light-emitting element columns of the plurality of organic light-emitting element groups are arranged adjacently; and a pixel circuit and a detection circuit which are connecting to each of the organic light-emitting element groups in the organic light-emitting element array.

The peripheral circuit region includes a pixel driving circuit, a detection driving circuit, and an integrated driving circuit, where the pixel driving circuit is connected to the pixel circuit, the detection driving circuit is connected to the detection circuit, and the integrated driving circuit is respectively connected to the pixel circuit and the detection circuit.

In a detection phase, the pixel driving circuit provides a non-enabling signal for the pixel circuit, the detection driving circuit provides an enabling signal for the detection circuit, and the integrated driving circuit provides a detection signal to the detection circuit, sequentially detects the multiple organic light-emitting element groups in a same organic light-emitting element row respectively, and acquires a compensation signal for one of the organic light-emitting elements.

In a display phase, the pixel driving circuit is used for providing an enabling signal to the pixel circuit, the integrated driving circuit is used for, according to the compensation signal, providing a compensation signal to the pixel circuit to compensate the organic light-emitting element.

In another aspect, an embodiment of the present disclosure further provides a compensation method for the display panel. The compensation method is used for compensating the display panel described in the first aspect and includes the steps described below. In a detection phase, the pixel driving circuit provides a non-enabling signal to the pixel circuit, the detection driving circuit provides an enabling signal to the detection circuit, and the integrated driving circuit provides a detection signal to the detection circuit, sequentially detecting multiple organic light-emitting element groups in a same organic light-emitting element row respectively, and acquiring a compensation signal for the organic light-emitting element. In a display phase, the pixel driving circuit provides an enabling signal to the pixel circuit, the integrated driving circuit, according to the compensation signal, provides a compensation signal to the pixel circuit to compensate the organic light-emitting element.

In a third aspect, an embodiment of the present disclosure further provides a display device including the display panel described in the first aspect. According to the display panel, the compensation method and the display device provided by the present disclosure, the organic light-emitting element array includes multiple organic light-emitting element groups, each organic light-emitting element groups includes multiple organic light-emitting element rows, and $i^{th}$ organic light-emitting element rows in each organic light-emitting element groups are arranged adjacently. Further, a detection circuit is added to the display region, and a detection driving circuit is added to the peripheral circuit area. In the detection phase, the organic light-emitting element rows in the multiple organic light-emitting element groups in a same organic light-emitting element row are sequentially detected, and a compensation signal for the organic light-emitting element is acquired so as to compensate the organic light-emitting element, so that precise detection result and compensation result are guaranteed, and good display uniformity of the display panel is after compensation is guaranteed.

BRIEF DESCRIPTION OF DRAWINGS

Other features, objects and advantages of the present disclosure will become more apparent from a detailed description of non-restrictive embodiments with reference to the drawings.

DETAILED DESCRIPTION

Figure 1:
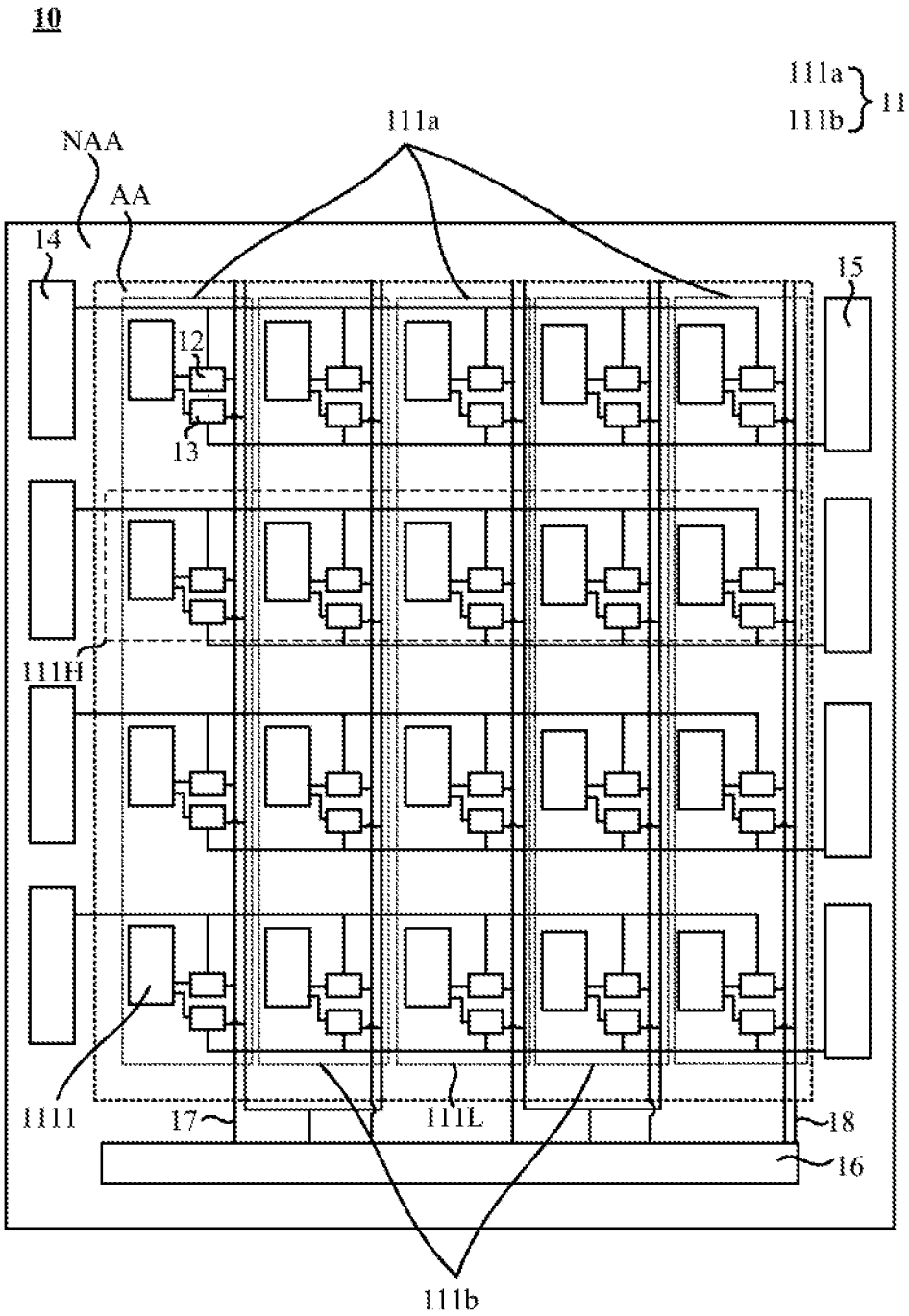
FIG. 1 is a structural diagram of a display panel according to an embodiment of the present disclosure.

FIG. 1 is a structural diagram of a display panel according to an embodiment of the present disclosure. As shown in FIG. 1, a display panel 10 according to an embodiment of the present disclosure includes a display region AA and a peripheral circuit region NAA surrounding the display region AA. The display region AA includes an organic light-emitting element array 11, and a pixel circuit 12 and a detection circuit 13 connected to each organic light-emitting element 1111 in the organic light-emitting element array. The organic light-emitting element array 11 includes multiple organic light-emitting element groups 111, each organic light-emitting element group 111 includes multiple organic light-emitting element columns 111L, and the $i^{th}$ organic light-emitting element column (111*i* is not shown here) in 111L in each organic light-emitting element group 111 are adjacently arranged, where $i \geq 1$ and i is an integer.

The peripheral circuit region NAA includes a pixel driving circuit 14, a detection driving circuit 15 and an integrated driving circuit 16, the pixel driving circuit 14 is connected to the pixel circuit 12, the detection driving circuit 15 is connected to the detection circuit 13, and the integrated driving circuit 16 is connected to the pixel circuit 12 and the detection circuit 13 respectively.

In a detection phase, the pixel driving circuit 14 provides a non-enabling signal to the pixel circuit 12, the detection driving circuit 15 provides an enabling signal to the detection circuit 13, and the integrated driving circuit 16 provides a detection signal to the detection circuit 13, sequentially detecting multiple organic light-emitting element groups in a same organic light-emitting element row 111H respectively, and acquiring a compensation signal for the organic light-emitting element.

In a display phase, the pixel driving circuit 14 provides an enabling signal to the pixel circuit 12, the integrated driving circuit 16, according to the compensation signal, provides a compensation signal to the pixel circuit 12 to compensate the organic light-emitting element 1111.

Exemplarily, as shown in FIG. 1, the display panel 10 according to the embodiment of the present disclosure may include multiple organic light-emitting element groups 111, and FIG. 1 only illustrates that the display panel 10 includes two organic light-emitting element groups 111*a* and 111*b*. Specifically, the organic light-emitting element group 111*a* may include odd columns of the organic light-emitting element column 111L, and the organic light-emitting element group 111*b* may include even columns of the organic light-emitting element column 111L. An $i^{th}$ organic light-emitting element column 111L in the organic light-emitting element group 111*a* is arranged adjacent to an $i^{th}$ organic light-emitting element column 111L in the organic light-emitting element group 111*b*, for example, a first organic light-emitting element column 111L in the organic light-emitting element group 111*a* is arranged adjacent to a first organic light-emitting element column 111L in the organic light-emitting element group 111*b*, a second organic light-emitting element column 111L in the organic light-emitting element group 111*a* is arranged adjacent to a second organic light-emitting element column 111L in the organic light-emitting element group 111*b*, and so on.

Further, the display panel 10 further includes a data signal line 17 and a detection signal line 18, the integrated driving circuit 16 is connected to the pixel circuit 12 through the data signal line 17 for providing a data signal to the pixel circuit 12 in the display phase. The integrated driving circuit 16 is connected to the detection circuit 13 through a detection signal line 18 for providing a detection signal to the detection circuit during the detection phase.

In the present disclosure, in the detection phase, the detection driving circuit 15 is controlled to provide a detection driving signal to the detection circuit 13, so as to ensure that detection is performed on multiple groups of organic light-emitting element groups 111 in a same organic light-emitting element row 111H, and the compensation signal for the organic light-emitting element is acquired, thus ensuring that the compensation signal is acquired for each organic light-emitting element 1111, ensuring that each organic light-emitting element 1111 corresponds to one compensation signal, ensuring that the compensation signal is precise to each organic light-emitting element, ensuring that compensation precision is high, and ensuring that display consistency of the display panel in the display phase is good.

Specifically, a step of performing detection of multiple organic light-emitting element groups 111 respectively in a same organic light-emitting element row 111H may include steps described below. First an organic light-emitting element group 111*a* in a first organic light-emitting element row is detected, then an organic light-emitting element group 111*b* in the first organic light-emitting element row, then an organic light-emitting element group 111*a* in a second organic light-emitting element row, and then an organic light-emitting element group 111*b* in the second organic light-emitting element row, so as to complete a detection process for organic light-emitting element groups 111 and organic light-emitting element groups 111*b* in all organic light-emitting element rows. Further, a step of performing respectively detection of the multiple organic light-emitting element groups 111 in a same organic light-emitting element row 111H may also include steps described below. Firstly, the organic light-emitting element group 111*a* in the first organic light-emitting element row is detected and then the organic light-emitting element group 111*a* in the second organic light-emitting element row is detected until the detection process is completed for the organic light-emitting element groups 111*a* in all organic light-emitting element rows. Then the organic light-emitting element group 111*b* in the first organic light-emitting element row is detected, and then the organic light-emitting element group 111*b* in the second organic light-emitting element row is detected until the detection process is completed for the organic light-emitting element groups 111*b* in all organic light-emitting element rows. The embodiment of the present disclosure does not limit how to implement the detection of the multiple organic light-emitting element groups 111 in a same organic light-emitting element row 111H, and only needs to detect each organic light-emitting element 1111 in an organic light-emitting element row manner, acquire a compensation signal of each organic light-emitting element 1111, and precisely compensate each organic light-emitting element 1111 based on the acquired compensation signal, thereby ensuring the compensation signal and further ensuring the good display uniformity of the display panel. It should be noted that, the embodiment of the present disclosure is only described by taking that the display panel 10 includes two groups of organic light-emitting element groups 111 as an example. It should be understood that the display panel 10 may include multiple groups of organic light-emitting element groups, for example, when the display panel 10 includes three groups of organic light-emitting element groups, a first group of organic light-emitting element group among the three groups of organic light-emitting element groups may include a $(3n+1)^{th}$ organic light-emitting element column, a second group of organic light-emitting element group among the three groups of organic light-emitting element groups may include a $(3n+2)^{th}$ organic light-emitting element column, and a third set of organic light-emitting element group in the three sets of organic light-emitting element groups may include a $(3n+2)^{th}$ organic light-emitting element column, thereby ensuring that $i^{th}$ columns of organic light-emitting element columns in each organic light-emitting element group may be adjacently arranged, where $i \geq 1$ and i is an integer, and $n \geq 1$ and n is an integer. When the display panel 10 includes four groups of organic light-emitting element groups, a first group of light-emitting element group among the four groups of organic light-emitting element groups may include a $(4m+1)^{th}$ organic light-emitting element column, a second light-emitting element group among the four groups of organic light-emitting element groups may include a $(4m+2)^{th}$ organic light-emitting element column, a third light-emitting element group among the four groups of organic light-emitting element groups may include a $(4m+3)^{th}$ organic light-emitting element column, and a fourth light-emitting element group among the four groups of organic light-emitting element groups may include a $(4m+4)^{th}$ organic light-emitting element column, thereby ensuring that the $i^{th}$ columns of organic light-emitting element columns of each organic light-emitting element group are adjacently arranged, where $i \geq 1$ and i is an integer, and $m \geq 1$ and m is an integer. The embodiment of the present disclosure does not limit how many groups of organic light-emitting element groups are specifically included in the display panel 10, and only needs to ensure that the $i^{th}$ columns of organic light-emitting element columns in each organic light-emitting element group are adjacently arranged.

Figure 2:
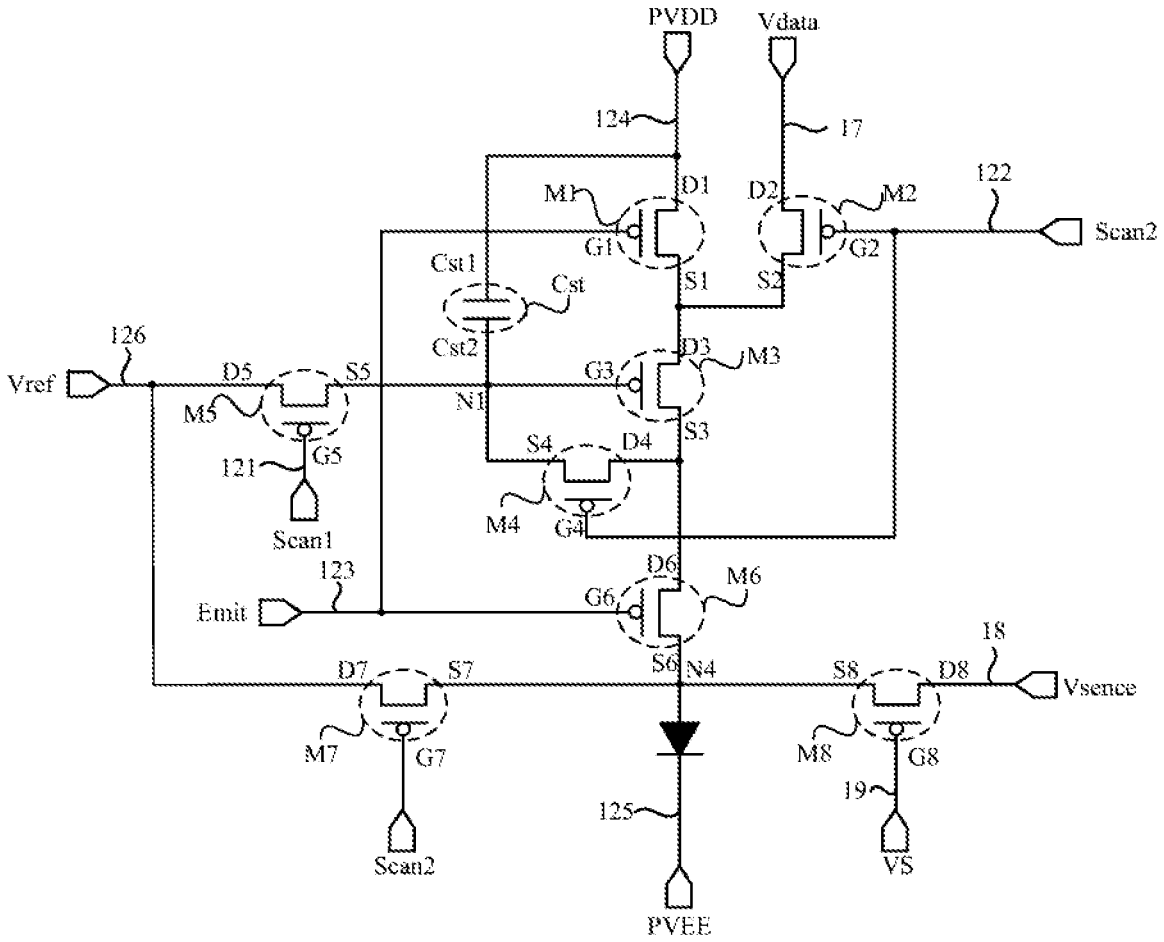
FIG. 2 is a structural diagram of a pixel circuit and a detection circuit according to an embodiment of the present disclosure.
Figure 3:
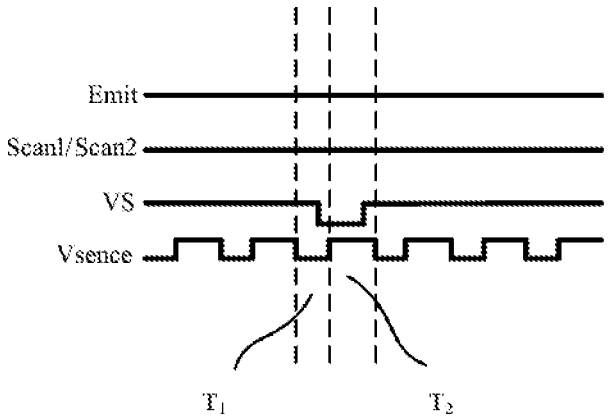
FIG. 3 is a schematic diagram of a detection timing sequence according to an embodiment of the present disclosure.
Figure 4:
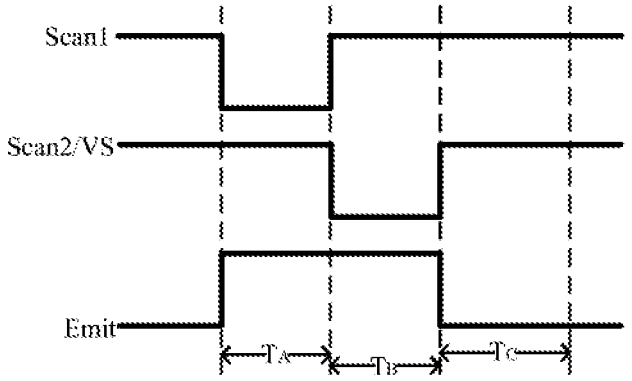
FIG. 4 is a schematic diagram of a display timing sequence according to an embodiment of the present disclosure.

Specifically, FIG. 2 is a structural diagram of a pixel circuit and a detection circuit according to an embodiment of the present disclosure, FIG. 3 is a schematic diagram of a detection timing sequence according to an embodiment of the present disclosure, and FIG. 4 is a schematic diagram of a display timing sequence according to an embodiment of the present disclosure. A working process of the display panel according to the present disclosure will be described in detail with reference to FIG. 2, FIG. 3 and FIG. 4.

FIG. 2 illustrates an example in which the pixel circuit 12 is a common 7T1C (seven thin film transistors and one storage capacitor) circuit and the detection circuit 13 includes one thin film transistor. As shown in FIG. 2, the display panel 10 may further include a first scanning line 121, a second scanning line 122, a light-emitting control signal line 123, a first power signal line 124, a second power signal line 125, a reference voltage line 126, a data signal line 17, a detection signal line 18, and a detection scanning line 19. Scan1 is a first scanning signal input to the first scanning line 121, Scan2 is a second scanning signal input to the second scanning line 122, Emit is a light-emitting control signal input to the light-emitting control signal line 123, Vdata is a data signal input to the data signal line 17, Vsence is a detection signal input to the detection signal line 18, VS is a detection scanning signal output to the detection scanning line 19, Vref is a reference voltage signal input to the reference voltage line 126, PVDD is a first power signal input to the first power signal line 124, and PVEE is a second power signal for forming a current loop of the organic light-emitting element.

Exemplarily, with continued reference to FIG. 2, the pixel circuit 12 may include a first light-emitting control transistor M1, a data signal writing transistor M2, a driving transistor M3, an additional transistor M4, a memory cell reset transistor M5 (i.e., a first reset transistor M5), a second light-emitting control transistor M6, a light-emitting reset transistor M7 (i.e., a second reset transistor M7), and a storage capacitor Cst. The detection circuit 13 may include a detection transistor M8.

The first scanning line 121 is electrically connected to a gate G5 of the memory cell reset transistor M5, a drain D5 of the memory cell reset transistor M5 is electrically connected to a source S7 of the light-emitting reset transistor M7 of a previous stage (a previous row) (a drain D5 of a first row of memory cell reset transistor M5 is electrically connected to the reference voltage line 126), a source S5 of the memory cell reset transistor M5 is electrically connected to a source S4 of the additional transistor M4, a gate G3 of the driving transistor M3 and a second plate Cst2 of the storage capacitor Cst; a drain D4 of the additional transistor M4 is electrically connected to a source S3 of the driving transistor M3 and a drain D6 of the second light-emitting control transistor M6, and a gate G4 of the additional transistor M4 is electrically connected to the second scanning line 122; the light-emitting control signal line 123 is electrically connected to gates of light-emitting control transistors (including a gate G1 of the first light-emitting control transistor M1 and a gate G6 of the second light-emitting control transistor M6), a drain D1 of the first light-emitting control transistor M1 is electrically connected to the second power signal line 125, a source S6 of the second light-emitting control transistor M6 is electrically connected to a metal anode of the organic light-emitting element 1111 and a source S7 of the light-emitting reset transistor M7, the source S3 of the driving transistor M3 is electrically connected to a drain D6 of the second light-emitting control transistor M6, a drain D3 of the driving transistor M3 is electrically connected to a source S1 of the first light-emitting control transistor M1 and a source S2 of the data signal writing transistor M2, a gate G3 of the driving transistor M3 is electrically connected to the second plate Cst2 of the storage capacitor, in an embodiment, the gate G3 of the driving transistor M3 is multiplexed as the second plate Cst2 of the storage capacitor Cst; a first plate Cst1 of the storage capacitor Cst is electrically connected to the first power signal line 124; a gate G2 of the data signal writing transistor M2 is electrically connected to the second scanning line 122, and a drain D2 of the data signal writing transistor M2 is electrically connected to the data signal line 17. A gate G8 of the detection transistor M8 is connected to the detection scanning line 19, a drain D8 of the detection transistor M8 is connected to the detection signal line 18, and a source S8 of the detection transistor M8 is connected to the metal anode of the organic light-emitting element 1111.

The memory cell reset transistor M5 and the additional transistor M4 may be double-gate transistors (not shown in the figure), so as to reduce leakage current and improve the control precision of the pixel driving circuit on the driving current, thereby facilitating the improvement of the control precision of the light-emitting brightness of the light-emitting element.

For transistors M1 to M7 as circled in FIG. 2, the gate G7 of the light-emitting reset transistor M7 is electrically connected to a first scanning line 121 in a next row, the first scanning line 121 in the next row is electrically connected to a second scanning line 122 in a current row. Therefore, for the current row, the gate G7 of the light-emitting reset transistor M7 is electrically connected to the second scanning line 122 in the current row.

The memory cell reset transistor M5 is used to provide a reset voltage for the storage capacitor Cst before the display phase, and the light-emitting reset transistor M7 is used to provide an initialization voltage to the organic light-emitting element 1111 before the display phase.

In implementations described above, each of the transistors M1 to M7 may be a P-type transistor or an N-type transistor, which is not limited in the embodiment of the present disclosure. Exemplarily, a detailed description on working principles of the pixel circuit and the detection circuit is given by taking a case that the transistors M1 to M7 are P-type transistors and a reference voltage signal Vref is a low-level signal as an example.

As shown in FIG. 3, since all of M1 to M7 are P-type transistors, in the detection phase, the signal Scan1 on the first scanning line 121, the signal Scan2 on the second scanning line 122, and the signal Emit on the light-emitting control signal line 123 are all set to be high-level signals, and a signal provided by the pixel driving circuit 14 to the pixel circuit 12 is a non-enabling signal, at this time, all of M1 to M7 are turned off, and a pixel electrode 12 is in a non-operating state. Since M8 is a P-type transistor, during the detection phase, the signal VS on the detection scanning line 19 is set to include a low-level signal, which ensures that a signal provided by the detection driving circuit 15 to the detection circuit 13 includes an enabling signal, and at this time, M8 is turned on, the detection circuit 13 is in an operating state. The detection signal Vsence on the detection signal line 18 can be transmitted to the organic light-emitting element 1111, which ensures that the organic light-emitting element 1111 can be detected and a compensation signal for the organic light-emitting element 1111 can be acquired. As shown in FIG. 3, the detection phase may include a first detection phase $T_1$ and a second detection phase $T_2$. In the first detection phase $T_1$, the detection signal Vsence is low, and a falling edge of the signal VS is within the first detection phase $T_1$; while in the second detection phase $T_2$, the detection signal Vsence is high, and a rising edge of the signal VS is within the second detection phase $T_2$.

As shown in FIG. 4, in a time period $T_A$ (an initial stage) of the display phase, the signal Scan1 in the first scanning line 121 is in a low-level state, the signal Scan2 in the second scanning line 122 and the signal Emit in the light-emitting control signal line 123 are in a high-level state. At this time, the memory cell reset transistor M5 is turned on. A potential Vref on the reference voltage line is applied to the second plate Cst2 of the storage capacitor Cst through the memory cell reset transistor M5. That is, a potential of a first node N1 (i.e. a metal part N1) is the reference voltage Vref. At this time, a potential of the gate G3 of the driving transistor M3 is also the reference voltage Vref.

In a time period t2 (a data signal voltage writing phase) of the display phase, the signal Scan2 on the second scanning line 122 is in a low-level state, the signal Scan1 on the first scanning line 121 and the signal Emit on the light-emitting control signal line 123 are in a high-level state. At this time, the data signal writing transistor M2 and the additional transistor M4 are turned on. Meanwhile, the potential of the gate G3 of the driving transistor M3 is the reference voltage Vref, which is also a low potential, and the driving transistor M3 is also turned on. A data signal Vdata including the compensation signal on the data line 17 is applied to the first node N1 through the data signal writing transistor M2, the driving transistor M3 and the additional transistor M4, and the potential of the first node N1 is gradually pulled up by the potential of the data line 17.

When a gate voltage of the driving transistor M3 is pulled up to a voltage that a voltage difference between a voltage of the source S3 and said voltage is not larger than a threshold voltage $V_{th}$ of the driving transistor M3, the driving transistor M3 will be in a cut-off state.

Since the source S3 of the driving transistor M3 is electrically connected to the data signal line 17 through the data signal writing transistor M2, a potential $V_{data}$ of the source S3 of the driving transistor M3 maintains unchanged. Thus, when the driving transistor M3 is cut off, the potential of the gate G3 of the driving transistor M3 is $V_{data}_|V_{th}|$, where $V_{data}$ is a value of the voltage on the data line and $|V_{th}|$ is a threshold voltage of the driving transistor M3.

At this time, a voltage difference Vc between the first plate Cst1 and the second plate Cst2 of the storage capacitor Cst is:

$$V_{PVDD}V_{data}|V_{th}|$$

where V1 represents the potential of the first plate Cst1, V2 represents the potential of the second plate Cst2, and $V_{PVDD}$ is a voltage value of a power signal on the first power signal line 124. In the data signal voltage writing phase, the voltage difference Vc between the first plate Cst1 and the second plate Cst2 of the storage capacitor Cst includes the threshold voltage $|V_{th}|$ of the driving transistor M3. That is, in the data signal voltage writing phase, the threshold voltage $V_{th}$ of the driving transistor M3 is detected and stored in the storage capacitor Cst.

In the data signal voltage writing phase, the light-emitting reset transistor T7 is also turned on, the light-emitting reset transistor M7 writes the potential Vref on the reference voltage line 126 into a first electrode of the organic light-emitting element 1111, and initializes the potential of the first electrode of the organic light-emitting element 1111, so that influence of a voltage of a first electrode of an organic light-emitting element 1111 in a previous frame on a voltage of a first electrode of an organic light-emitting element 1111 in the next frame can be reduced, and the display uniformity can be further improved.

In a time period $T_C$ (a light-emitting phase, or a display phase), the signal Emit on the light-emitting control signal line 123 is in a low-level state, the signal Scan1 on the first scanning line 121 and the signal Scan2 on the second scanning line 122 are in a high-level state. At this time, the first light-emitting control transistor M1 and the second light-emitting control transistor M6 are turned on, the voltage of the source S3 of the driving transistor M3 is $V_{PVDD}$, and a voltage difference between the source and the gate of the driving transistor M3 is:

$$V_{sg}=V_{PVDD}-(V_{data}-|V_{th}|).$$

The light-emitting unit 122 is driven by a drain current of the driving transistor M3 to emit light, and the current $I_d$ of the driving transistor satisfies the following formula:

$$I_d=\frac{1}{2}\mu C_{ox}\frac{W}{L}(V_{sg}-|V_{th}|)^2=\frac{1}{2}\mu C_{ox}\frac{W}{L}(V_{PVDD}-V_{data}+|V_{th}|-|V_{th}|)^2=\frac{1}{2}\mu C_{ox}\frac{W}{L}(V_{PVDD}-V_{data})^2,$$

where μ is a mobility of carriers of the driving transistor M3, W and L are respectively a length and a width of a channel of the first light-emitting control transistor M1 and the second light-emitting control transistor M6, $C_{ox}$ is a capacitance of a gate oxide of the driving transistor M3 in an unit area, and $V_{PVDD}$ is the voltage on the first power signal line 151, $V_{data}$ is the voltage on the data signal line 17. The $V_{data}$ signal includes the compensation signal acquired during the detection phase, so as to ensure the compensation of the organic light-emitting element 1111 during the display phase.

As can be known from the above description of the working principles of the pixel circuit 12 and the detection circuit 13, by reasonably setting the driving signals provided by the pixel driving circuit 14 and the detection driving circuit 15, and reasonably setting the detection signal and the data signal provided by the integrated driving circuit 16, the detection and compensation processes of the organic light-emitting element 1111 can be completed, so as to ensure that the organic light-emitting element 1111 acquires the compensation signal in the display phase, and the display uniformity of all organic light-emitting elements 1111 in the display panel 10 is good.

Specifically, in the detection process, the detection signal Vsref provided by the integrated driving circuit 16 may be a voltage signal, and at this time, the current flowing through the organic light-emitting element 1111 may be detected to acquire a current voltage-current curve of the organic light-emitting element; or, the detection signal Vsref provided by the integrated driving circuit 16 may be a current signal, and at this time, a voltage value at two ends of the organic light-emitting element 1111 may be detected to acquire the current voltage-current curve of the organic light-emitting element. Since the organic light-emitting element 1111 is a current driving element, the organic light-emitting element 1111 may be aged after working for a certain time, and the current-voltage correspondence of the organic light-emitting element 1111 may change. In the embodiment of the present disclosure, the current voltage-current curve of the organic light-emitting element 1111 is acquired by detecting the organic light-emitting element 1111, and the degradation degree of the organic light-emitting element 1111 is connected by comparing the initial voltage-current curve stored before shipment of the organic light-emitting element 1111 from the factory, so as to compensate the organic light-emitting element 1111 through the data signal provided by the data signal line 17 in the display phase.

It should be noted that, in the embodiment of the present disclosure, the working process of the display panel is described only by taking that the pixel circuit is a 7T1C circuit as an example. It should be understood that, in the display panel provided in the embodiment of the present disclosure, the pixel circuit may also be in other forms, for example, a 2T1C circuit or a 4T1C circuit, and a specific form of the pixel electrode is not limited in the embodiment of the present disclosure. When the pixel circuit is the 7T1C circuit, a threshold shift of the driving transistor may be compensated, and the display brightness of the organic light-emitting element 1111 is ensured to be related to the power supply signal and the data signal only.

Furthermore, when the Emit, Scan1 and Scan2 signals each are high-level signals, and the PVDD, PVEE and Vref signals may each be zero values, thereby ensuring a lower power consumption of the display panel.

In summary, the embodiment of the present disclosure provides the display panel, in which the organic light-emitting element array is configured to include multiple groups of organic light-emitting element groups, each organic light-emitting element group includes multiple columns of organic light-emitting element columns, and $i^{th}$ columns of organic light-emitting element columns in each organic light-emitting element group are adjacently arranged. Further, a detection circuit is added in the display region, a detection driving circuit is added in the peripheral circuit region. In the detection phase, organic light-emitting element columns in the multiple groups of organic light-emitting element groups in a same organic light-emitting element row are respectively and sequentially detected, and the compensation signal for the organic light-emitting element is acquired to compensate the organic light-emitting element, so that the detection result and the compensation result are precise, and the display uniformity of the display panel is good after compensation.

In an embodiment, in the detection phase, sequentially detecting the organic light-emitting element columns in the multiple organic light-emitting element groups in a same organic light-emitting element row may be implemented by reasonably setting a timing sequence of the detection driving signal provided by the detection driving circuit 15, and detecting the organic light-emitting element columns by detecting the timing sequence of the driving signal, so that each organic light-emitting column or multiple columns of organic light-emitting element columns correspond to a same detection signal line 18, which may greatly reduce a number of output terminals on the integrated driving circuit 16, reduce the cost of the integrated driving circuit 16 and the binding yield.

The following is a detailed description of how to implement the detection of the organic light-emitting element column by setting the timing sequence of the detection driving signal.

Figure 5:
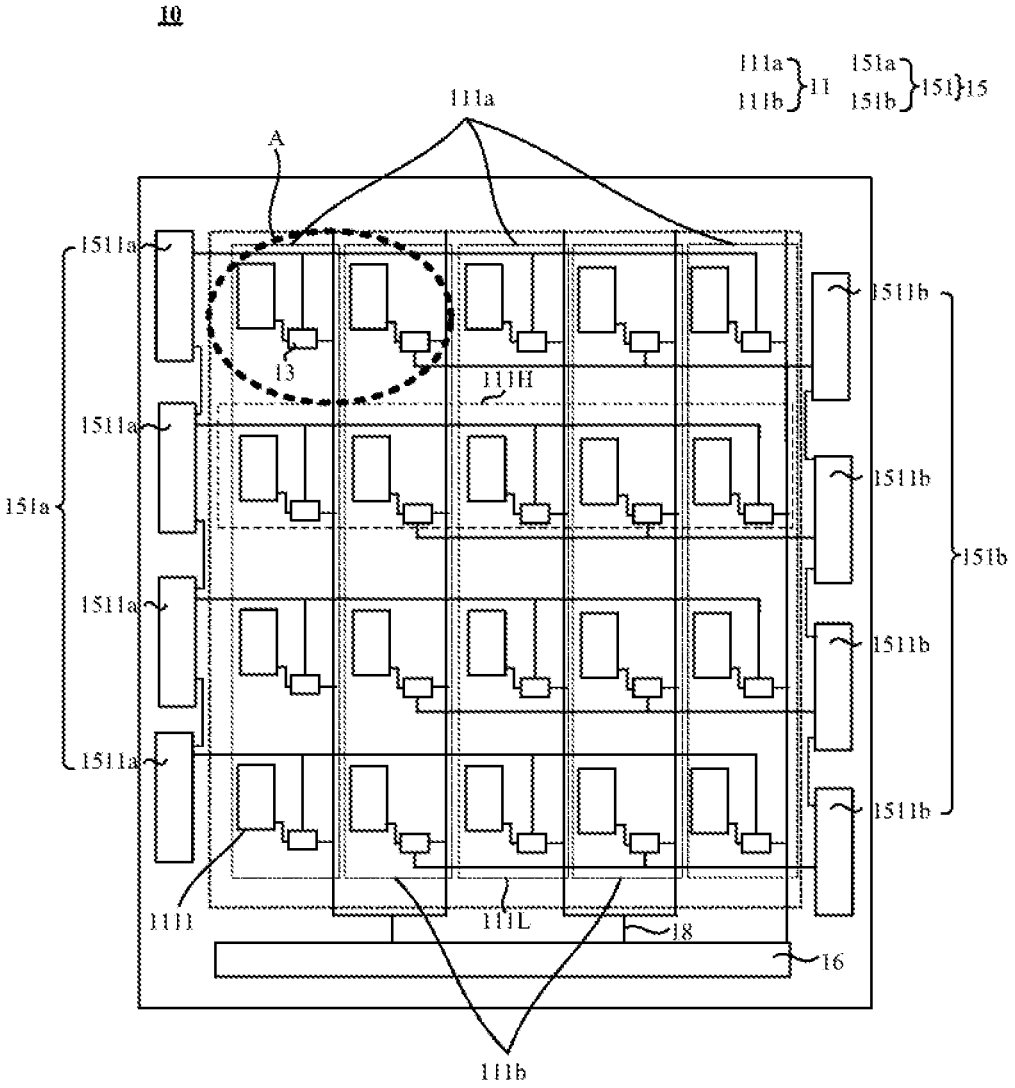
FIG. 5 is a structural diagram of another display panel according to an embodiment of the present disclosure.

FIG. 5 is a structural diagram of another display panel according to an embodiment of the present disclosure. As shown in FIG. 5, the detection driving circuit 15 includes multiple groups of first detection shift register circuits 151, and the first detection shift register circuits 151 are in a one-to-one correspondence with the organic light-emitting element groups. The first detecting shift register circuit 151 includes multiple stages of first detecting shift registers 1511 sequentially arranged in cascade, and a number of stages of the first detecting shift register circuits 151 is the same as a number of organic light-emitting element rows 111H. The first detection shift register 1511 in each stage is electrically connected to the detection circuit 12 corresponding to the organic light-emitting elements 1111 arranged in a same row in a same organic light-emitting element group 111. The display panel 10 further includes multiple detection signal lines 18, one end of the $j^{th}$ detection signal line is electrically connected to the integrated driving circuit 16, and another end is electrically connected to the detection circuit 13 corresponding to the $j^{th}$ organic light-emitting element column 111L in each organic light-emitting element group 111, where j≥1 and j is an integer.

As shown in FIG. 5, the detection driving circuit 15 includes multiple groups of first detection shift register circuits 151, and the first detection shift register circuits 151 are in a one-to-one correspondence with the organic light-emitting element groups 111 for detecting the organic light-emitting element groups 111. Further, the first detection shift register circuit 151 includes multiple stages of first detection shift registers 1511 which are sequentially arranged in cascade, and a number of stages of the first detection shift register circuit 151 is the same as a number of organic light-emitting element rows 111H in the organic light-emitting element group 111. The first detection shift register 1511 in each stage is electrically connected to the detection circuit 12 corresponding to the multiple organic light-emitting elements 1111 arranged in a same row in the organic light-emitting element group 111, which is used for driving the organic light-emitting elements 1111 in a same organic light-emitting element row 111H in the organic light-emitting element group 111. Further, the $j^{th}$ detection signal line 18 is electrically connected to the detection circuit 13 corresponding to the $j^{th}$ organic light-emitting element column 111L in each organic light-emitting element group 111 respectively, which is used for providing a detection signal to the detection circuit 13 corresponding to the $j^{th}$ organic light-emitting element column 111L in each organic light-emitting element group 111.

Figure 6:
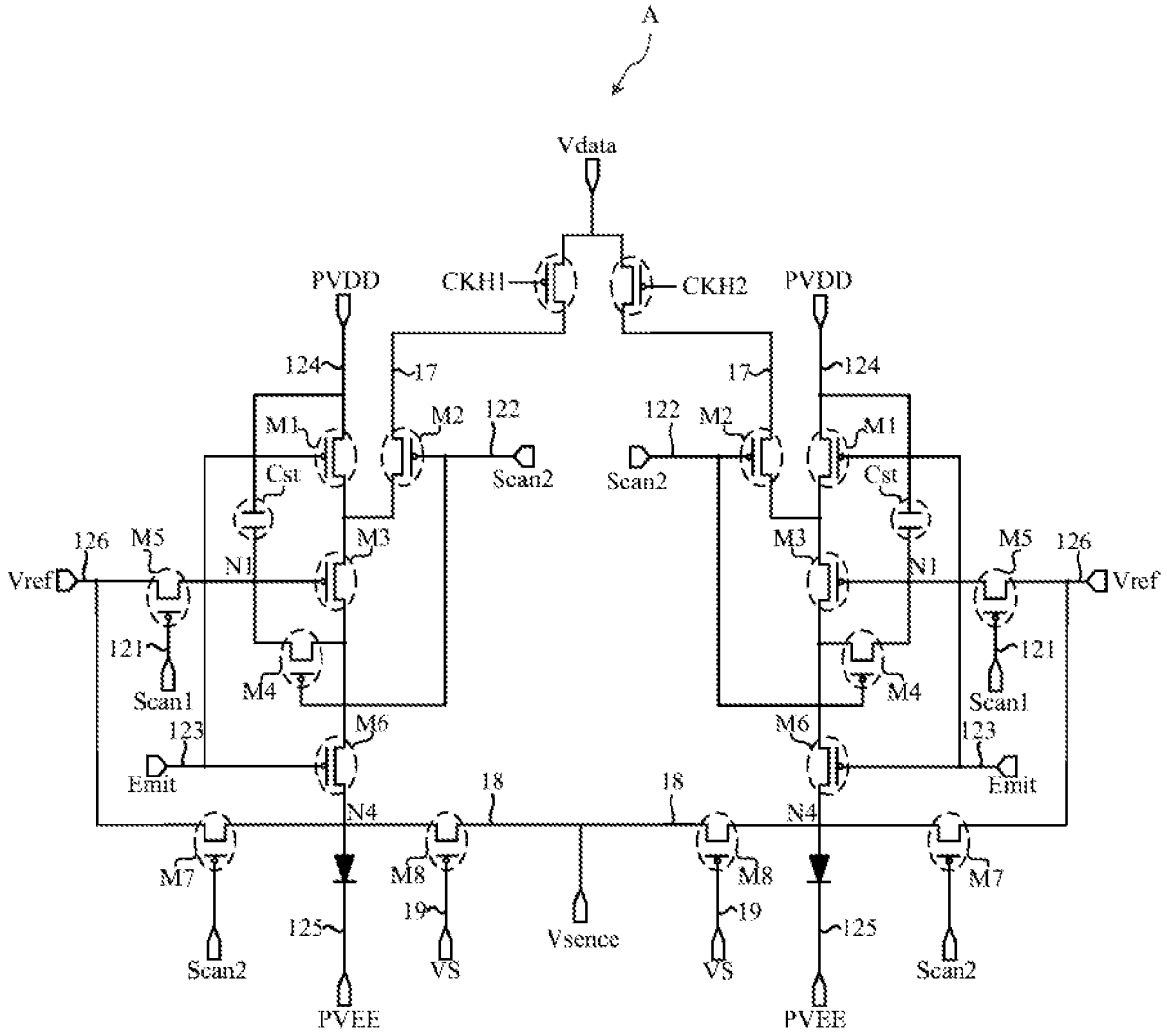
FIG. 6 is a schematic diagram showing the detailed structure of region A in FIG. 5.
Figure 7:
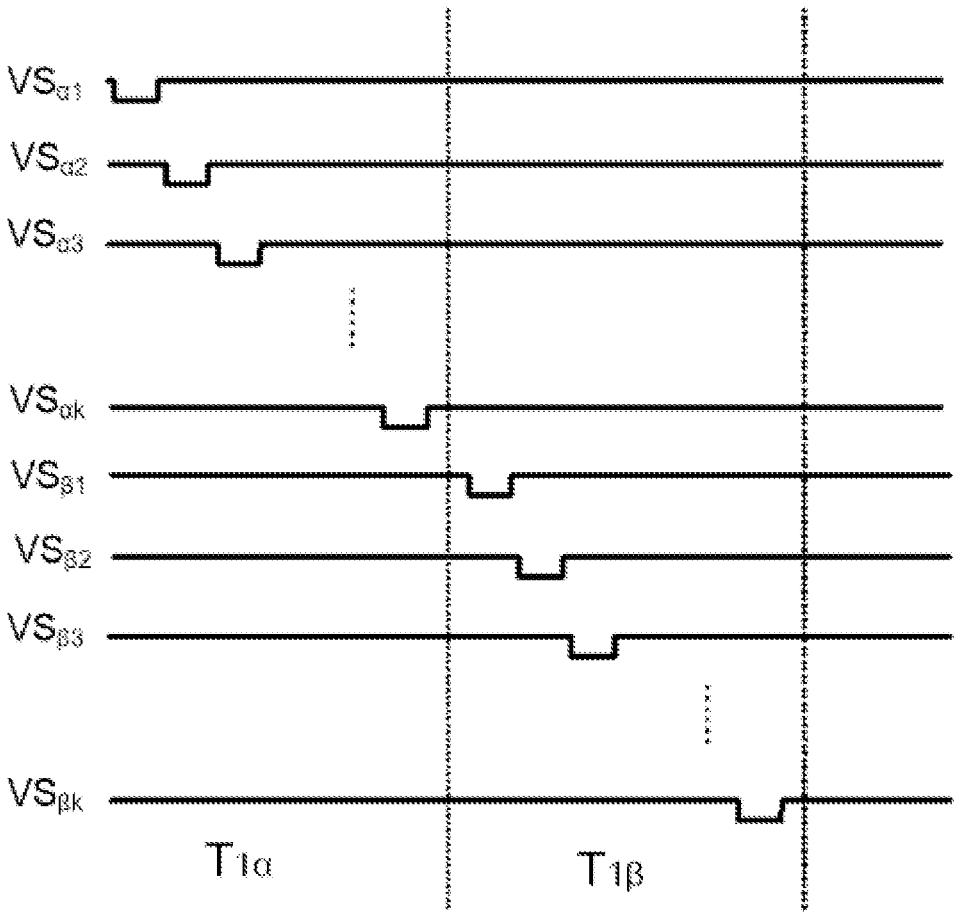
FIG. 7 is a schematic diagram of another detection timing sequence according to an embodiment of the present disclosure.

Specifically, FIG. 6 is a schematic diagram showing the detailed structure of region A in FIG. 5 and FIG. 7 is a schematic diagram of another detection timing sequence according to an embodiment of the present disclosure. Referring to FIG. 5, FIG. 6 and FIG. 7, the first detection shift register circuit 151 includes at least a first alpha detection shift register circuit 151*a* and a first beta detection shift register circuit 151*b*. The organic light-emitting element group 111 includes at least an alpha organic light-emitting element group 111*a* and a beta organic light-emitting element group 111*b*. FIG. 5 illustrates an example in which only the first detection shift register circuit 151 includes the first alpha detection shift register circuit 151*a* and the first beta detection shift register circuit 151*b*, and the organic light-emitting element group 111 includes the alpha organic light-emitting element group 111*a* and the beta organic light-emitting element group 111*b*. The first alpha detection shift register circuit 151*a* is electrically connected to the alpha organic light-emitting element group 111*a*, and the first beta detection shift register circuit 151*b* is electrically connected to the beta organic light-emitting element group 111*b*.

The detection phase includes at least a first alpha detection phase and a first beta detection phase which are arranged sequentially.

In the first alpha detection phase, the first alpha detection shift register circuit 151*a* is used for providing an enabling signal for the detection circuit 13 corresponding to the alpha organic light-emitting element group 111*a* and the integrated drive circuit 16 is used for providing the detection signal for the detection circuit 13 corresponding to the alpha organic light-emitting element group 111*a*.

In the first beta detection phase, the first beta detection shift register circuit 151*b* is used for providing an enabling signal for the detection circuit 13 corresponding to the beta organic light-emitting element group 111*b* and the integrated drive circuit 16 is used for providing the detection signal for the detection circuit 13 corresponding to the beta organic light-emitting element group 111*b*.

The display panel described in various forms in FIG. 5, FIG. 6 and FIG. 7 is an example in which the detection of all organic light-emitting elements 1111 in the alpha organic light-emitting element group 111*a* is completed, and then the detection of all organic light-emitting elements 1111 in the beta organic light-emitting element group 111*b* is completed. As shown in FIG. 5 and FIG. 7, the first detection shift register circuit 151*a* includes K (K is an integer greater than 1) stages of first detection shift registers 1511*a* which are sequentially arranged in cascade, and a number of stages of the first detection shift register circuit 151*a* is the same as a number of the organic light-emitting element rows 111H in the organic light-emitting element group 111*a*. The first detection shift register 1511*a* in each stage is electrically connected to the detection circuit 13 corresponding to the multiple organic light-emitting elements 1111 arranged in a same row in the organic light-emitting element group 111*a*. As shown in FIG. 7, the first alpha detection phase is represented by $T_{1\alpha}$ and the first beta detection phase is represented by $T_{1\beta}$. In the first alpha detection phase $T_{1\alpha}$, a first alpha detection shift register 1511*a* in a $j^{th}$ (j=1, 2, 3, . . . , K) stage is used for providing an enabling signal $VS_{\alpha j}$, which corresponds to the $j^{th}$ signal VS in the first alpha detection phase $T_{1\alpha}$ in FIG. 7, to the detection circuit 13 corresponding to a $j^{th}$ organic light-emitting element row 111H in the alpha organic light-emitting element group 111*a*, driving the detection circuit 13 corresponding to the organic light-emitting element 1111 in a same organic light-emitting element row 111H in the alpha organic light-emitting element group 111*a* to be turned on, and at this time, the multiple detection signal lines 18 respectively provide detection signals to the multiple organic light-emitting element columns 111L in the alpha organic light-emitting element group 111*a*, detect the multiple organic light-emitting element columns 111L in the alpha organic light-emitting element group 111*a*, and respectively acquire the compensation signal of each organic light-emitting element column in the alpha organic light-emitting element group 111*a*. In the first beta detection phase $T_{1\beta}$, the first beta detection shift register 1511*b* in the $j^{th}$ stage is used for providing an enabling signal $VS_{\beta j}$, which corresponds to the $j^{th}$ signal VS in the first alpha detection phase $T_{1\beta}$ in FIG. 7, to the detection circuit 13 corresponding to each organic light-emitting element row 111H in the beta organic light-emitting element group 111*b*, driving the detection circuit 13 corresponding to the organic light-emitting element 1111 in a same organic light-emitting element row 111H in the beta organic light-emitting element group 111*b* to be turned on, and at this time, the multiple detection signal lines 18 respectively provide detection signals to the multiple organic light-emitting element columns 111L in the beta organic light-emitting element group 111*b*, detect the multiple organic light-emitting element columns 111L in the beta organic light-emitting element group 111*b*, and respectively acquire the compensation signal of each organic light-emitting element column in the beta organic light-emitting element group 111*b*. In this way, the entire detection process of the alpha organic light-emitting element group 111*a* and the beta organic light-emitting element group 111*b* is completed, and the compensation signal of each organic light-emitting element 1111 in the alpha organic light-emitting element group 111*a* and the beta organic light-emitting element group 111*b* is acquired.

In this way, by reasonably setting the detection driving circuit 15 and the detection timing sequence, the entire detection process of the organic light-emitting element array 11 is completed by sequentially detecting different organic light-emitting element groups 111, so as to ensure that each organic light-emitting element 1111 in the organic light-emitting element array 11 can acquire the precise compensation signal. In the display phase, the organic light-emitting element 1111 is compensated by the data signal including the compensation signal, thereby ensuring good uniformity of display effect of the entire display panel.

Figure 8:
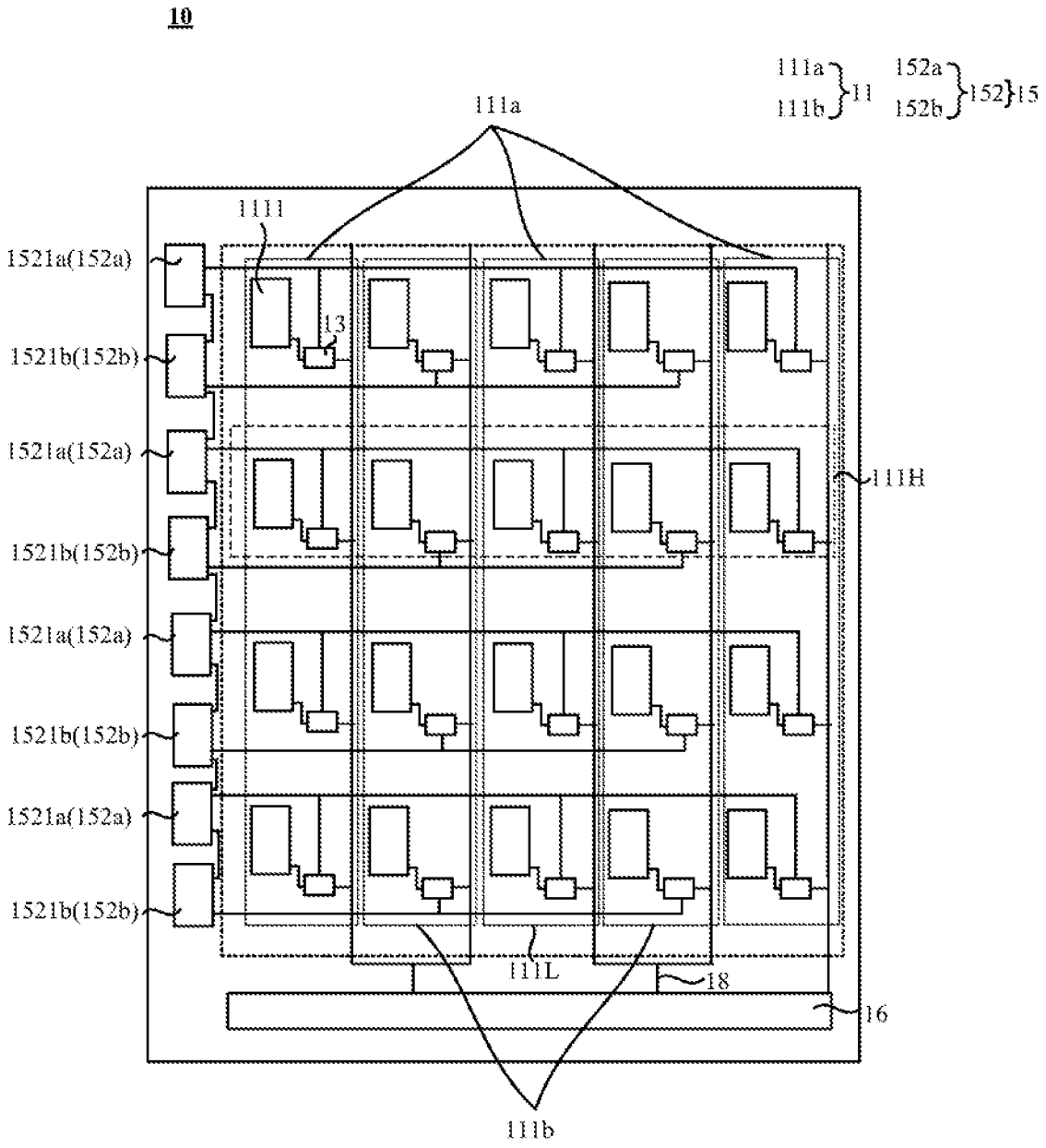
FIG. 8 is a structural diagram of another display panel according to an embodiment of the present disclosure.

FIG. 8 is a structural diagram of another display panel according to an embodiment of the present disclosure. As shown in FIG. 8, the detection driving circuit 15 includes a second detection shift register circuit 152. The second detecting shift register circuit 152 includes multiple stages of second detecting shift registers 1521 which are sequentially arranged in cascade, and a number n of stages of the second detecting shift register circuit 152, a number m of the organic light-emitting element rows 111H, and a number k of the organic light-emitting element groups 11 meet n=m*k; the detection circuits corresponding to the organic light-emitting elements 1111 in the multiple organic light-emitting element groups 111 in a same organic light-emitting element row 111H are electrically connected to the multiple stages of second detection shift registers 1521 which are arranged next to each other, respectively. The display panel 10 further includes multiple detection signal lines 18, one end of the $j^{th}$ detection signal line is electrically connected to the integrated driving circuit 16, and another end is electrically connected to the detection circuit 13 corresponding to the $j^{th}$ organic light-emitting element column 111L in each organic light-emitting element group 111, where $j \geq 1$ and j is an integer.

As shown in FIG. 8, the detection driving circuit 15 includes a second detecting shift register circuit 152, and the number n of stages of the second detecting shift register circuit 152, the number m of the organic light-emitting element rows 111H, and the number k of the organic light-emitting element groups 11 meet n=m*k, that is, the number of the second detecting shift registers 1521 corresponding to each organic light-emitting element row 111H is the same as the number of the organic light-emitting element groups 111. Furthermore, the detection circuits corresponding to the organic light-emitting elements 1111 in the multiple organic light-emitting element groups 111 in a same organic light-emitting element row 111H are electrically connected to the multiple stages of the second detection shift registers 1521 which are arranged adjacently, and the second detection shift register 1521 in each stage is used to drive the detection circuit 13 corresponding to one organic light-emitting element group 111 in one organic light-emitting element row 111H. Further, the $j^{th}$ detection signal line 18 is electrically connected to the detection circuit 13 corresponding to the $j^{th}$ organic light-emitting element column 111L in each organic light-emitting element group 111 respectively, which is used to provide the detection signal to the detection circuit 13 corresponding to the $j^{th}$ organic light-emitting element column 111L in each organic light-emitting element group 111.

Figure 9:
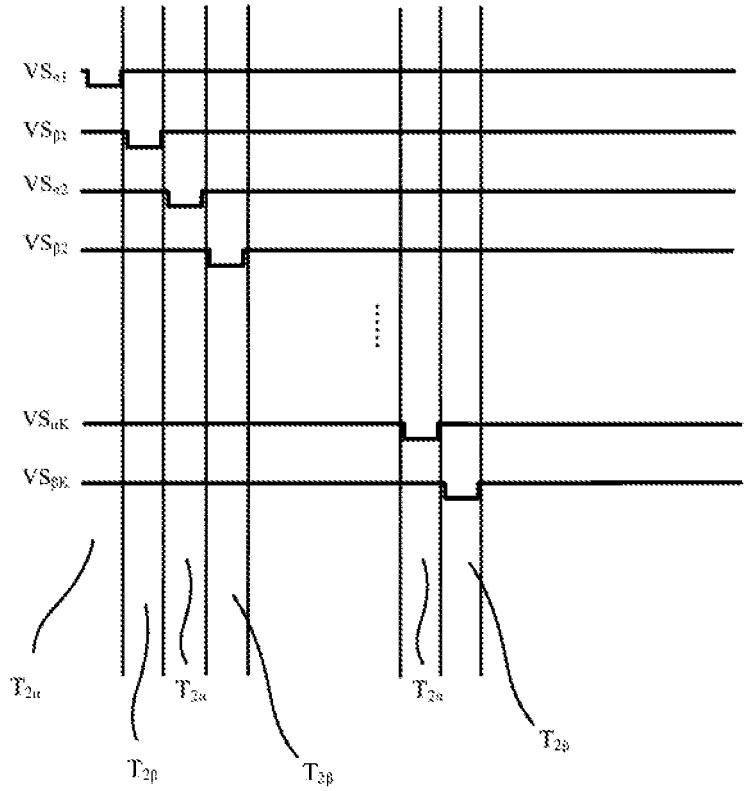
FIG. 9 is a schematic diagram of another detection timing sequence according to an embodiment of the present disclosure.

Specifically, FIG. 9 is a schematic diagram of another detection timing sequence according to an embodiment of the present disclosure. As shown in FIG. 6, FIG. 8 and FIG. 9, the second detection shift register circuit 152 includes at least a second alpha detection shift register circuit 152*a* and a second beta detection shift register circuit 152*b*. The second alpha detection shift register circuit 152*a* includes K (K is an integer greater than 1) stages of second alpha detection shift registers 1521*a*, the second beta detection shift register circuit 152*b* includes K stages of second beta detection shift registers 1521*b*, and the second alpha detection shift registers 1521*a* and the second beta detection shift registers 1521*b* are sequentially arranged in cyclic cascade. The organic light-emitting element group 111 includes at least an alpha organic light-emitting element group 111*a* and a beta organic light-emitting element group 111*b*, and FIG. 8 illustrates an example in which only that the second detection shift register circuit 152 includes a second alpha detection shift register circuit 152*a* and a second beta detection shift register circuit 152*b*, and the organic light-emitting element group 111 includes the alpha organic light-emitting element group 111*a* and the beta organic light-emitting element group 111*b*. The second alpha detection shift register 1521*a* in each stage is electrically connected to the alpha organic light-emitting element group 111*a* in a same organic light-emitting element row 111H, and the second beta detection shift register 1521*b* in each stage is electrically connected to the beta organic light-emitting element group 111*b* in a same organic light-emitting element row 111H.

The detection phase includes at least K second alpha detection phases $T_{2\alpha}$ and K second beta detection phases $T_{2\beta}$, and the K second alpha detection phases $T_{2\alpha}$ and the K second beta detection phases $T_{2\beta}$ are arranged sequentially and cyclically.

In the second alpha detection phase $T_{2\alpha}$, the second alpha detection shift register 1521*a* in a $j^{th}$ (j=1, 2, . . . , K) stage is used for providing the enabling signal $VS_{\alpha j}$, which corresponds to the $j^{th}$ signal VS in the second alpha detection phase $T_{2\alpha}$ in FIG. 7, for the alpha organic light-emitting element group 111*a* in a same organic light-emitting element row 111H; and the integrated drive circuit 16 is used for providing the detection signal for the detection circuit 13 corresponding to the alpha organic light-emitting element group 111*a*.

In the second beta detection phase $T_{2\beta}$, the second beta detection shift register 1521*b* in the $j^{th}$ stage is used for providing the enabling signal $VS_{\beta j}$, which corresponds to the $j^{th}$ signal VS in the second beta detection phase $T_{2\beta}$ in FIG. 7, for the beta organic light-emitting element group 111*b* in a same organic light-emitting element row 111H; and the integrated drive circuit 16 is used for providing the detection signal for the detection circuit 13 corresponding to the beta organic light-emitting element group 111*b*.

The display panel provided in FIG. 8 and FIG. 9 detects the alpha organic light-emitting element group 111*a* in the first organic light-emitting element row, then detects the beta organic light-emitting element group 111*b* in the first organic light-emitting element row, then detects the alpha organic light-emitting element group 111*a* in the second organic light-emitting element row, and then detects the beta organic light-emitting element group 111*b* in the second organic light-emitting element row, so that the detection process of the alpha organic light-emitting element groups 111*a* and the beta organic light-emitting element groups 111*b* in all organic light-emitting element rows is completed. As shown in FIG. 8 and FIG. 9, the second detection shift register circuit 152 includes a second alpha detection shift register circuit 152*a* and a second beta shift register circuit beta 152*b*. The second alpha detection shift register circuit 152*a* includes multiple stages of the second alpha detection shift registers 1521*a*, the second beta shift register circuit 152*b* includes multiple stages of the second beta detection shift registers 1521*b*, and the second alpha detection shift registers 1521*a* and the second beta detection shift registers 1521*b* are sequentially arranged in cyclic cascade. The second alpha detection shift register 1521*a* in each stage is electrically connected to the alpha organic light-emitting element group 111*a* in a same organic light-emitting element column 111H. In the second alpha detection phase, the second alpha detection shift register 1521*a* in each stage is used for providing the enabling signal to the detection circuit 13 corresponding to the alpha organic light-emitting element group 111*a* in a same organic light-emitting element row 111H to drive the detection circuit 13 corresponding to the alpha organic light-emitting element group 111*a* in a same organic light-emitting element row 111H to be turned on, and at this time, the multiple detection signal lines 18 respectively provide detection signals to the multiple organic light-emitting elements 1111 in the alpha organic light-emitting element group 111*a* in a same organic light-emitting element row 111H. The multiple organic light-emitting element rows 1111 in the alpha organic light-emitting element group 111*a* in a same organic light-emitting element row 111H are detected, and the compensation signal of each organic light-emitting element 1111 in the alpha organic light-emitting element group 111*a* in the same organic light-emitting element row 111H is acquired. The second beta detection shift register 1521*b* in each stage is electrically connected to the beta organic light-emitting element group 111*b* in a same organic light-emitting element column 111H. In the second beta detection phase, the second alpha detection shift register 1521*b* in each stage is used for providing the enabling signal to the detection circuit 13 corresponding to the beta organic light-emitting element group 111*b* in a same organic light-emitting element row 111H to drive the detection circuit 13 corresponding to the beta organic light-emitting element group 111*b* in a same organic light-emitting element row 111H to be turned on, and at this time, the multiple detection signal lines 18 respectively provide detection signals to the multiple organic light-emitting elements 1111 in the beta organic light-emitting element group 111*b* in a same organic light-emitting element row 111H. The multiple organic light-emitting element rows 1111 in the beta organic light-emitting element group 111*b* in a same organic light-emitting element row 111H are detected, and the compensation signal of each organic light-emitting element 1111 in the beta organic light-emitting element group 111*b* in the same organic light-emitting element row 111H is acquired. In this way, the detection process of the same organic light-emitting element row 111H is completed, and then the detection process of a next organic light-emitting element row 111H is completed until the detection processes of all organic light-emitting element rows 111H are completed, that is, the detection process of the entire organic light-emitting element array 11 is completed, and the compensation signal of each organic light-emitting element 1111 in the alpha organic light-emitting element group 111*a* and the beta organic light-emitting element group 111*b* is acquired.

In this way, by reasonably setting the detection driving circuit 15 and the detection timing sequence, and sequentially detecting different organic light-emitting element groups 111 in the same organic light-emitting element row 111H, then the entire detection process of the organic light-emitting element array 11 in the order of the organic light-emitting element rows 111H is completed, so as to ensure that each organic light-emitting element 1111 in the organic light-emitting element array 11 can acquire the precise compensation signal. In the display phase, the organic light-emitting element 1111 is compensated by the data signal including the compensation signal, thereby ensuring good uniformity of the display effect of the entire display panel.

Figure 10:
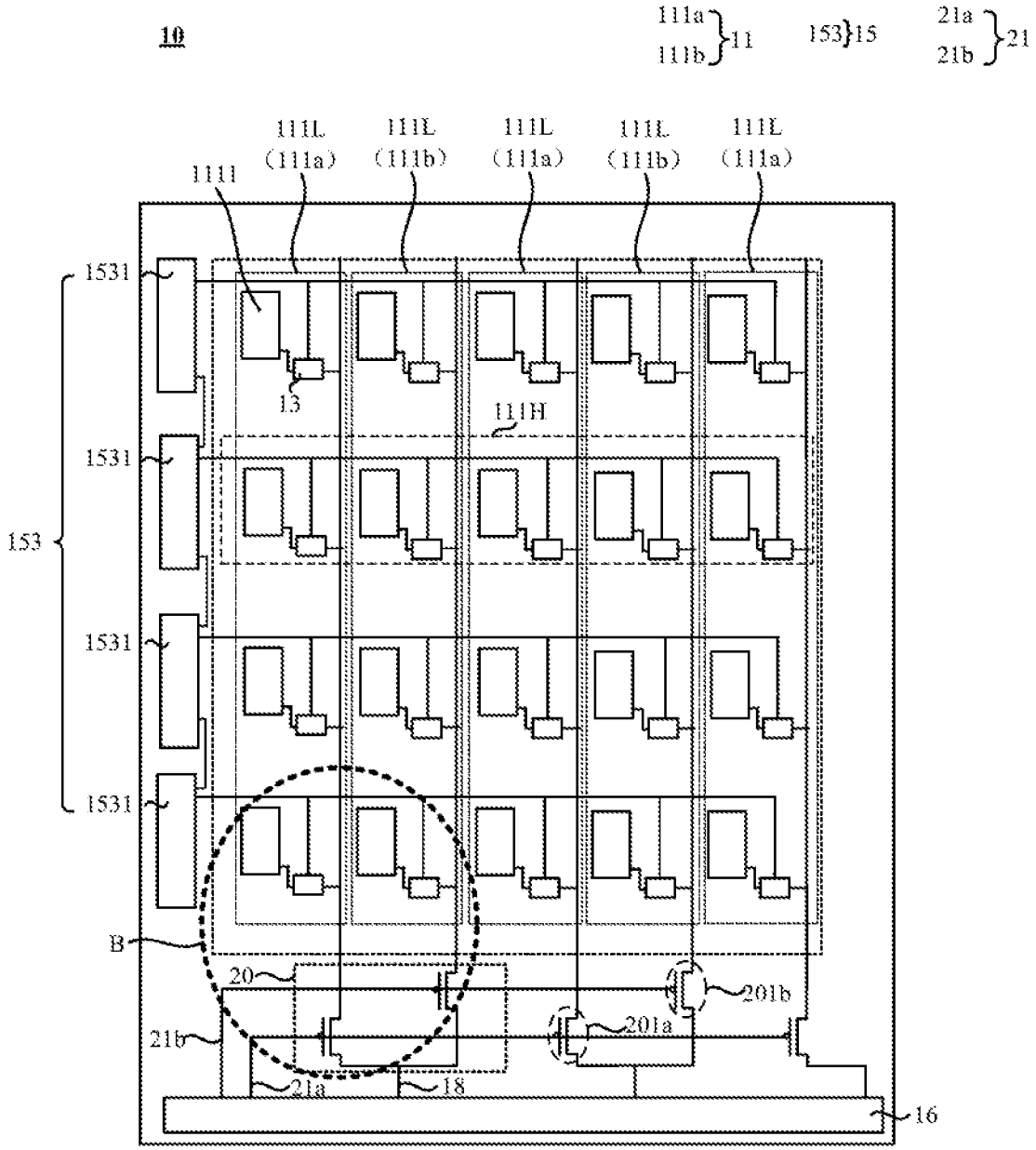
FIG. 10 is a structural diagram of another display panel according to an embodiment of the present disclosure.
Figure 11:
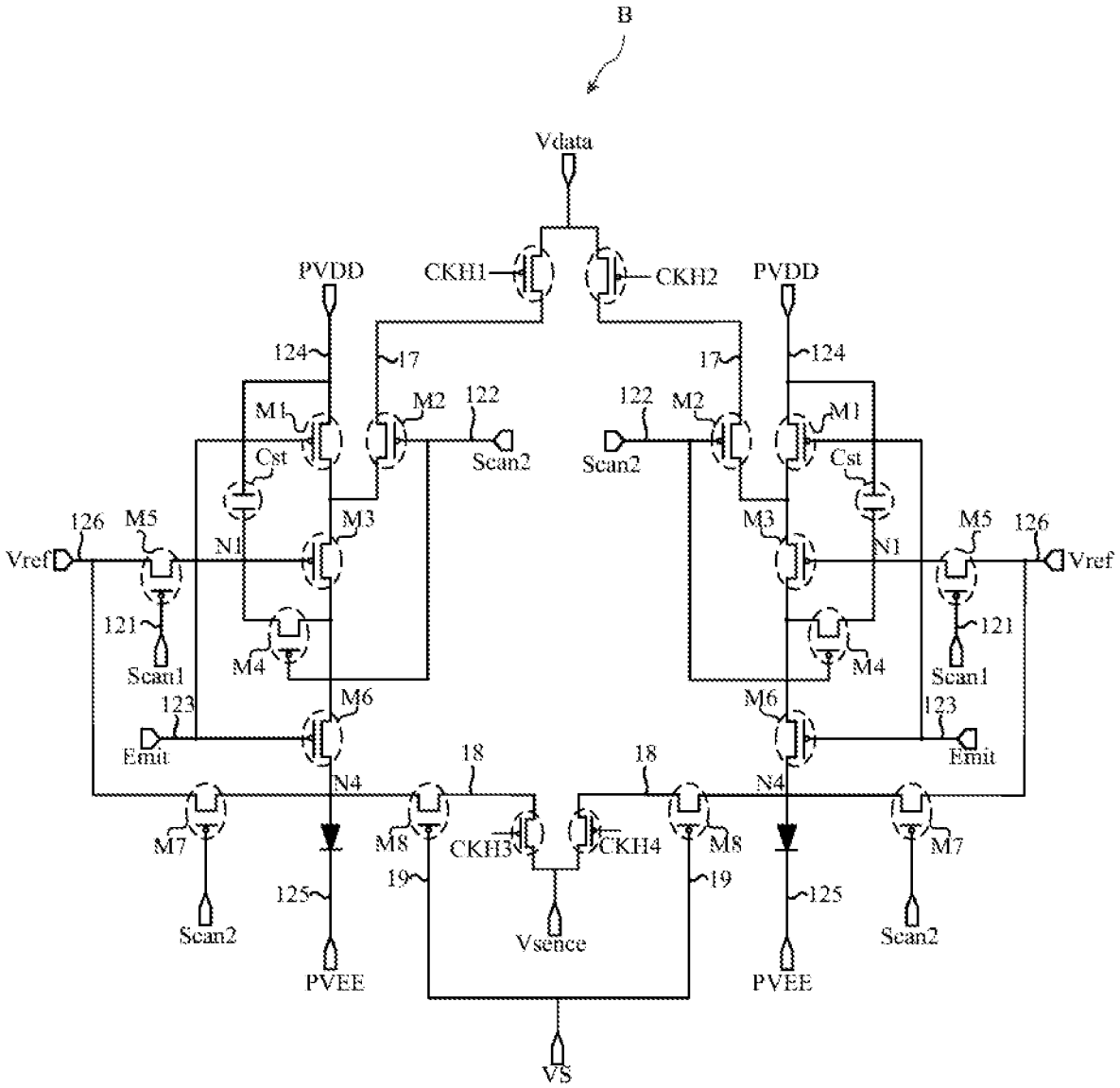
FIG. 11 is a schematic diagram showing the detailed structure of region B in FIG. 10.

FIG. 10 is a structural diagram of another display panel according to an embodiment of the present disclosure, and FIG. 11 is a schematic diagram showing the detailed structure of region B in FIG. 10. As shown in FIG. 10 and FIG. 11, the detection driving circuit 15 includes a third detection shift register circuit 153. The third detection shift register circuit 153 includes multiple stages of third detection shift registers 1531 which are sequentially arranged in cascade, and a number of stages of the third detection shift register circuit 153 is the same as a number of the organic light-emitting device rows 111H. The third detection shift register 1531 in each stage is electrically connected to the detection circuit corresponding to the multiple organic light-emitting elements 1111 arranged in a same column. The display panel 10 further includes multiple groups of the multi-output selection circuits 20 and multiple clock signal lines 21. Each group of the multi-output selection circuits 20 includes multiple switch elements 201, and a number of the switch elements 201 in each group of the multi-output selection circuit 20 is the same as a number of the organic light-emitting element groups 111. Each clock signal line 21 is electrically connected to the switch element 201 which is connected to the same organic light-emitting element group 111. The display panel 10 further includes multiple detection signal lines 18, one end of each detection signal line 18 is electrically connected to the integrated driving circuit 16, another end of each detection signal line 18 is electrically connected to a signal input terminal of each group of the multi-output selection circuit 20, and a signal output terminal of each group of the multi-output selection circuit 20 is connected to an organic light-emitting element row 111L through the switch element 201.

As shown in FIG. 10, the detection driving circuit 15 includes the third detection shift register circuit 153, and the number of stages of the third detection shift register circuit 153 is the same as the number of the organic light-emitting element rows 111H. Each third detection shift register 1531 is electrically connected to the detection circuits 13 corresponding to the multiple organic light-emitting elements 1111 in the same organic light-emitting element row 111H, that is, the third detection shift register 1531 in each stage is used for driving multiple detection circuits 13 in the same organic light-emitting element column 111H. Further, the display panel 10 further includes multiple groups of multi-output selection circuits 20 and multiple clock signal lines 21, and the number of the switch elements 201 in each group of multi-output selection circuits 20 is the same as the number of the organic light-emitting element groups 111, and each clock signal line 21 is electrically connected to the switch element 201 which is connected to the same organic light-emitting element group 111, so that the clock signal provided by the clock signal line 21 controls the switch element 201 corresponding to the same organic light-emitting element group 111 to be turned on and off, and controls whether the detection signal can be transmitted to the organic light-emitting element 1111 through the detection circuit 13.

Figure 12:
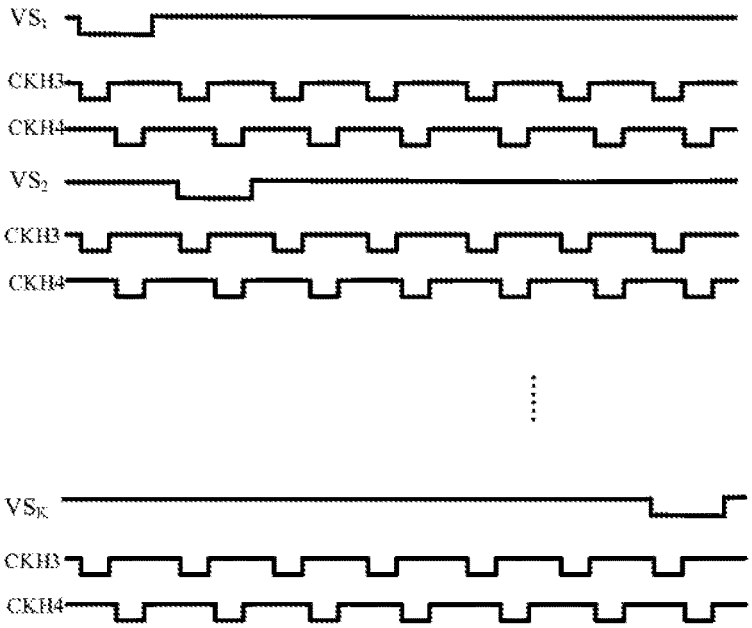
FIG. 12 is a schematic diagram of another detection timing sequence according to an embodiment of the present disclosure.

Specifically, FIG. 12 is a schematic diagram of another detection timing sequence according to an embodiment of the present disclosure. In conjunction with FIG. 10, FIG. 11, and FIG. 12, the organic light-emitting element group 111 includes at least an alpha organic light-emitting element group 111*a* and a beta organic light-emitting element group 111*b*. Each group of the multi-output selection circuit 20 includes at least an alpha switch element 201*a* and a beta switch element 201*b* and the K clock signal lines 21 at least include a first clock signal line 21*a* and a second clock signal line 21*b*. FIG. 10 illustrates an example in which only the organic light-emitting element group 111 includes an alpha organic light-emitting element group 111*a* and a beta organic light-emitting element group 111*b*, each group of the multi-output selection circuit 20 includes the alpha switch element 201*a* and the beta switch element 201*b*, and the K clock signal lines 21 include the alpha clock signal line 21*a* and the beta clock signal line 21*b*.

The detection phase includes at least K (K is an integer greater than 1) third alpha detection phases and K third beta detection phases, and the K third alpha detection phases and the K third beta detection phases are arranged sequentially and cyclically.

In the third alpha detection phase, the third detection shift register 1531 in a $j^{th}$ (j=1, 2, . . . , K) stage is used for providing the enabling signal $VS_j$ for the organic light-emitting elements 111 in a same organic light-emitting element row 111H, the alpha clock signal line 21*a* is used for providing an alpha enabling signal to the alpha switch element 201*a* in duration of the enabling signal, and the integrated driving circuit 16 is used for providing the detection signal for the alpha organic light-emitting element group 111*a*.

In the third beta detection phase, the third detection shift register 1531 in each stage is used for providing the enabling signal $VS_j$ for the organic light-emitting elements 111 in a same organic light-emitting element row 111H, the beta clock signal line 21*b* is used for providing a beta enabling signal to the beta switch element 201*b* in duration of the enabling signal, and the integrated driving circuit 16 is used for providing the detection signal for the beta organic light-emitting element group 111*b*.

The display panel provided in FIG. 10, FIG. 11 and FIG. 12 detects the alpha organic light-emitting element group 111*a* in the first organic light-emitting element row, then detects the beta organic light-emitting element group 111*b* in the first organic light-emitting element row, then detects the alpha organic light-emitting element group 111*a* in the second organic light-emitting element row, and then detects the beta organic light-emitting element group 111*b* in the second organic light-emitting element row, so that the detection processes of the alpha organic light-emitting element groups 111*a* and the beta organic light-emitting element groups 111*b* in all organic light-emitting element rows are completed. As shown in FIG. 10 and FIG. 12, in the third alpha detection phase, the third detection shift register 1531 in each stage is used for providing the enabling signal to the organic light-emitting elements 1111 in the same organic light-emitting element row 111H, and drive all detection circuits 13 corresponding to the alpha organic light-emitting element group 111*a* and the beta organic light-emitting element group 111*b* in the same organic light-emitting element row 111H to be turned on, at this time, the alpha clock signal line 21*a* provides the alpha enabling signal to the alpha switch element 201*a*, and the alpha switch element 201*a* is turned on. At this time, the multiple detection signal lines 18 respectively provide detection signals to the multiple organic light-emitting elements 1111 in the alpha organic light-emitting element group 111*a* in the same organic light-emitting element row 111H. The multiple organic light-emitting elements 1111 in the alpha organic light-emitting element group 111*a* in the same organic light-emitting element row Ill H are detected, and the compensation signal of each organic light-emitting element 1111 in the alpha organic light-emitting element group 111*a* in the same organic light-emitting element row 111H is acquired. In the third beta detection phase, the third detection shift register 1531 in each stage is used for providing the enabling signal to the organic light-emitting elements 1111 in the same organic light-emitting element row 111H, and drive all detection circuits 13 corresponding to the alpha organic light-emitting element group 111*a* and the beta organic light-emitting element group 111*b* in the same organic light-emitting element row 111H to be turned on, at this time, the beta clock signal line 21*b* provides the beta enabling signal to the beta switch element 201*b*, and the beta switch element 201*b* is turned on. At this time, the multiple detection signal lines 18 respectively provide detection signals to the multiple organic light-emitting elements 1111 in the beta organic light-emitting element group 111*b* in the same organic light-emitting element row 111H. The multiple organic light-emitting elements 1111 in the beta organic light-emitting element group 111*b* in the same organic light-emitting element row 111H are detected, and the compensation signal of each organic light-emitting element 1111 in the beta organic light-emitting element group 111*b* in the same organic light-emitting element row 111H is acquired. In this way, the detection process of the same organic light-emitting element row 111H is completed, and then the detection process of a next organic light-emitting element row 111H is completed until the detection processes of all organic light-emitting element rows 111H are completed, that is, the detection process of the entire organic light-emitting element array 11 is completed, and the compensation signal of each organic light-emitting element 1111 in the alpha organic light-emitting element group 111*a* and the beta organic light-emitting element group 111*b* is acquired.

Further, the beta enabling signal and the alpha enabling signal do not overlap, in this way, the detection processes of the alpha organic light-emitting element group 111*a* and the beta light-emitting element group 111*b* do not overlap, thereby ensuring that the detection of the alpha organic light-emitting element group 111*a* and the detection of the beta organic light-emitting element group 111*b* can be independently completed, the acquired compensation signal is precise, the organic light-emitting element 1111 can be precisely compensated, and the display uniformity of the display panel is good.

In this way, by reasonably setting the detection driving circuit 15 and the detection timing sequence, and sequentially detecting different organic light-emitting element groups 111 in the same organic light-emitting element row 111H, then the entire detection process of the organic light-emitting element array 11 in the order of the organic light-emitting element rows 111H is completed, thereby ensuring that each organic light-emitting element 1111 in the organic light-emitting element array 11 can acquire the precise compensation signal. In the display phase, the organic light-emitting element 1111 is compensated by the data signal including the compensation signal, thereby ensuring good uniformity of the display effect of the entire display panel.

In summary, the above embodiments illustrate in three feasible implementations that the detection driving signals provided by the detection driving circuit can be set to sequentially detect the organic light-emitting element columns in the multiple organic light-emitting element groups in the same organic light-emitting element row respectively in the detection phase, so as to ensure that each organic light-emitting element in the organic light-emitting element array can acquire an precise compensation signal. In the display phase, the organic light-emitting element is compensated by the data signal including the compensation signal, thereby ensuring good uniformity of the display effect of the entire display panel. Further, each organic light-emitting column or multiple organic light-emitting element rows correspond to a same detection signal line, so that a number of output terminals on the integrated drive circuit can be greatly reduced, and the cost and the binding yield of the integrated drive circuit are reduced.

In an embodiment, with continued reference to FIG. 4, during a part of the display phase, the detection driving circuit 15 may be used to provide the enabling signal to the detection circuit 13, and the integrated driving circuit 16 may be used to provide the reset signal to the detection circuit 13.

Exemplarily, in a $T_B$ time period (a data signal voltage writing phase) of the part of the display phase, the VS signal provided by the detection driving circuit 15 is at a low-level, and the detection circuit 13 is turned on, the integrated driving circuit 16 can provide the reset signal to the organic light-emitting element 1111 through the detection circuit 13, so as to implement the reset operation of the organic light-emitting element 1111.

In an embodiment, with continued reference to FIG. 3, the detection phase includes the first detection phase and the second detection phase.

In the first detection phase, the integrated driving circuit 16 is used to provide the reset signal to the detection circuit 13 for implementing the reset operation of the organic light-emitting element 1111; and in the second detection phase, the integrated driving circuit 16 is used to provide the detection signal to the detection circuit 13 for detecting the organic light-emitting element 1111 to acquire the compensation signal for the organic light-emitting element 1111. The detection phase is configured to include the first detection phase and the second detection phase. In the first detection phase, the organic light-emitting element 1111 is reset, and in the second detection phase, the organic light-emitting element is detected, so as to ensure that each detection process will not be interfered by the previous detection process, the acquired compensation signal is precise, and each organic light-emitting element can be compensated precisely.

In an embodiment, with continued reference to FIG. 1 and FIG. 2, the detection circuit 13 provided in the embodiment of the present disclosure may include a thin film transistor M8, a gate G8 of the thin film transistor M8 is electrically connected to the detection driving circuit 15, a first electrode D8 of the thin film transistor M8 is electrically connected to the integrated driving circuit 16, and the second electrode S8 of the thin film transistor M8 is electrically connected to the organic light-emitting element 1111. It should be noted that, in the embodiment of the present disclosure, only taking that the thin film transistor M8 is a P-type thin film transistor as an example, when the thin film transistor M8 is a P-type thin film transistor, the first electrode of the thin film transistor M8 may be a drain D8, and the second electrode may be a source S8; when the thin film transistor M8 is an N-type thin film transistor, the first electrode of the thin film transistor M8 may be a source S8, and the second electrode may be a drain D8. The type of the thin film transistor is not limited in the embodiment of the present disclosure.

In an embodiment, as shown in FIG. 6 and FIG. 11, the display panel provided by the embodiment of the present disclosure may further include multiple multi-output selection circuits 22. The multi-output selection circuit 22 may include at least two switch elements. FIG. 6 and FIG. 11 only take a case that the multi-output selection circuit 22 includes two switch elements corresponding two clock signals CKH1 and CKH2 as an example, so as to implement a 1-to-2 multi-output, that is, one data signal output terminal on the integrated driving circuit 16 corresponds to two data signal lines 17, thereby reducing the number of data signal output terminals in the integrated driving circuit 16 and reducing the cost of the integrated driving circuit 16.

Figure 13:
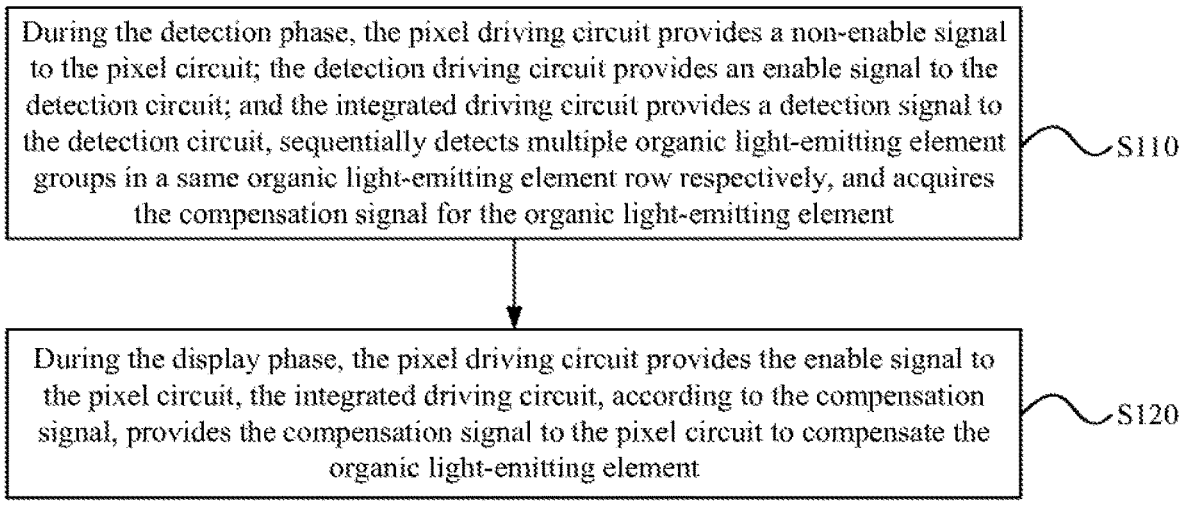
FIG. 13 is a flowchart of a compensation method of a display panel according to an embodiment of the present disclosure.

Based on a same the concept, the embodiment of the present disclosure further provides a compensation method for the display panel, which is used to compensate the display panel provided by the embodiment of the present disclosure. FIG. 13 is a flowchart of a compensation method of a display panel according to an embodiment of the present disclosure. As shown in FIG. 13, the compensation method of a display panel according to the embodiment of the present disclosure includes steps described below.

In S110, during the detection phase, the pixel driving circuit provides a non-enabling signal to the pixel circuit; the detection driving circuit provides an enabling signal to the detection circuit; and the integrated driving circuit provides a detection signal to the detection circuit, sequentially detects multiple organic light-emitting element groups in a same organic light-emitting element row respectively, and acquires the compensation signal for the organic light-emitting element.

As shown in FIG. 2 and FIG. 3, in the detection phase, the signal Scan1 on the first scanning line 121, the signal Scan2 on the second scanning line 122, and the signal Emit on the light-emitting control signal line 123 are all high-level signals, the signal provided by the pixel driving circuit 14 to the pixel circuit 12 is a non-enabling signal, at this time, at this time all of M1 to M7 are turned off, and the pixel electrode 12 is in a non-operating state. Since M8 is a P-type transistor, during the detection phase, the signal VS on the detection scanning line 19 is set to include a low-level signal, which ensures that a signal provided by the detection driving circuit 15 to the detection circuit 13 includes an enabling signal, and at this time, M8 is turned on, the detection circuit 13 is in an operating state. The detection signal Vsence on the detection signal line 18 can be transmitted to the organic light-emitting element 1111, which ensures that the organic light-emitting element 1111 can be detected and a compensation signal for the organic light-emitting element 1111 can be acquired.

In S120, during the display phase, the pixel driving circuit provides the enabling signal to the pixel circuit, the integrated driving circuit, according to the compensation signal, provides the compensation signal to the pixel circuit to compensate the organic light-emitting element.

As shown in FIG. 1, FIG. 2 and FIG. 4, during a time period $T_A$ (an initial phase) of the display phase, the signal Scan1 on the first scanning line 121 is a low-level signal, the signal Scan2 on the second scanning line 122 and the signal Emit on the light-emitting control signal line 123 are high-level signals. At this time, the memory cell reset transistor M5 is turned on, the potential of the first node N1 is the reference voltage Vref, and the potential of the gate G3 of the driving transistor M3 is also the reference voltage Vref. In a time period $T_B$ (a data signal voltage writing phase) of the display phase, the signal Scan2 on the second scanning line 122 is a low-level signal, the signal Scan1 on the first scanning line 121 and the signal Emit on the light-emitting control signal line 123 are high-level signals, at this time, the data signal writing transistor M2 and the additional transistor M4 are turned on, the driving transistor M3 is also turned on, the data signal Vdata including the compensation signal on the data signal line 17 is applied to the first node N1 through the data signal writing transistor M2, the driving transistor M3 and the additional transistor M4. Meanwhile, the voltage difference Vc between the first plate Cst1 and the second plate Cst2 of the storage capacitor Cst includes the threshold voltage $V_{th}$ of the driving transistor M3. That is, in the data signal voltage writing phase, the threshold voltage $V_{th}$ of the driving transistor M3 is detected, and the threshold voltage $V_{th}$ and the compensation signal are stored in the storage capacitor Cst. In a time period $T_C$ (a light-phase, or a display phase), the signal Emit on the light-emitting control signal line 123 is in a low-level state, the signal Scan1 on the first scanning line 121 and the signal Scan2 on the second scanning line 122 are in a high-level state. At this time, the first light-emitting control transistor M1 and the second light-emitting control transistor M6 are turned on, and the current $I_d$ of the driving transistor satisfies the following formula:

$$\begin{aligned} I_d &= \frac{1}{2}\mu C_{ox}\frac{W}{L}(V_{sg}-|V_{th}|)^2 \\ &= \frac{1}{2}\mu C_{ox}\frac{W}{L}(V_{PVDD}-V_{data}+|V_{th}|-|V_{th}|)^2 \\ &= \frac{1}{2}\mu C_{ox}\frac{W}{L}(V_{PVDD}-V_{data})^2 \end{aligned}$$

In this way, a signal $V_{data}$ including the compensation signal is written into the organic light-emitting element.

In summary, the compensation method for the display panel provided by the embodiment of the present disclosure can complete the detection and compensation processes of the organic light-emitting elements by reasonably setting the pixel driving circuit and the driving signal provided by the detection driving circuit in the detection phase and the display phase, and reasonably setting the detection signal and the data signal provided by the integrated driving circuit, thereby ensuring that each organic light-emitting element acquires a precise compensation signal in the display phase and ensuring that the display uniformity of all organic light-emitting elements in the display panel is good.

Figure 14:
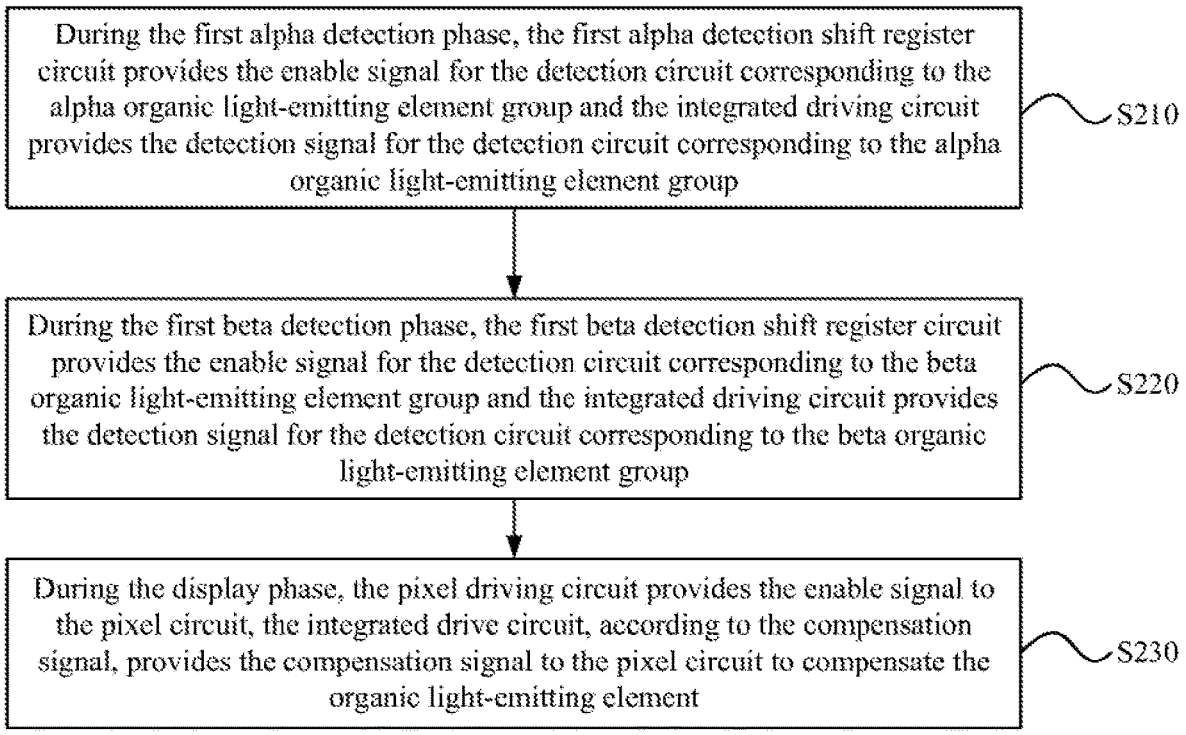
FIG. 14 is a flowchart of a compensation method of another display panel according to an embodiment of the present disclosure.

In an embodiment, FIG. 14 is a flowchart of another compensation method of a display panel according to an embodiment of the present disclosure. With continued reference to FIG. 5, FIG. 6 and FIG. 7, the detection driving circuit 15 includes multiple groups of first detection shift register circuits 151, and the first detection shift register circuits 151 correspond to the organic light-emitting element groups 111 one-to-one. The first detection shift register circuit 151 includes multiple stages of first detection shift registers 1511 arranged in cascade, and the number of stages of the first detection shift register circuit 151 is the same as the number of organic light-emitting element rows 111H. The first detection shift register circuit 151 includes at least a first alpha detection shift register circuit 151*a* and a first beta detection shift register circuit 151*b*. The organic light-emitting element group 111 includes at least an alpha organic light-emitting element group 111*a* and a beta organic light-emitting element group 111*b*, where the first alpha detection shift register circuit 151*a* is electrically connected to the alpha organic light-emitting element group 111*a*, and the first beta detection shift register circuit 151*b* is electrically connected to the beta organic light-emitting element group 111*b*.

The detection phase includes at least a first alpha detection phase and a first beta detection phase which are arranged sequentially.

Based on the structure of the display panel described above, the compensation method for the display panel provided by the embodiment of the present disclosure may include steps described below.

In S210, during the first alpha detection phase, the first alpha detection shift register circuit provides the enabling signal for the detection circuit corresponding to the alpha organic light-emitting element group and the integrated driving circuit provides the detection signal for the detection circuit corresponding to the alpha organic light-emitting element group.

In S220, during the first beta detection phase, the first beta detection shift register circuit provides the enabling signal for the detection circuit corresponding to the beta organic light-emitting element group and the integrated driving circuit provides the detection signal for the detection circuit corresponding to the beta organic light-emitting element group.

In S230, during the display phase, the pixel driving circuit provides the enabling signal to the pixel circuit, the integrated drive circuit, according to the compensation signal, provides the compensation signal to the pixel circuit to compensate the organic light-emitting element.

In summary, the compensation method for the display panel according to the embodiment of the present disclosure completes the detection process of the entire organic light-emitting element array by sequentially detecting different organic light-emitting element groups, so as to ensure that each organic light-emitting element in the organic light-emitting device array can acquire a precise compensation signal. In the display phase, the organic light-emitting element is compensated by the data signal including the compensation signal, thereby ensuring good uniformity of display effect of the entire display panel.

Figure 15:
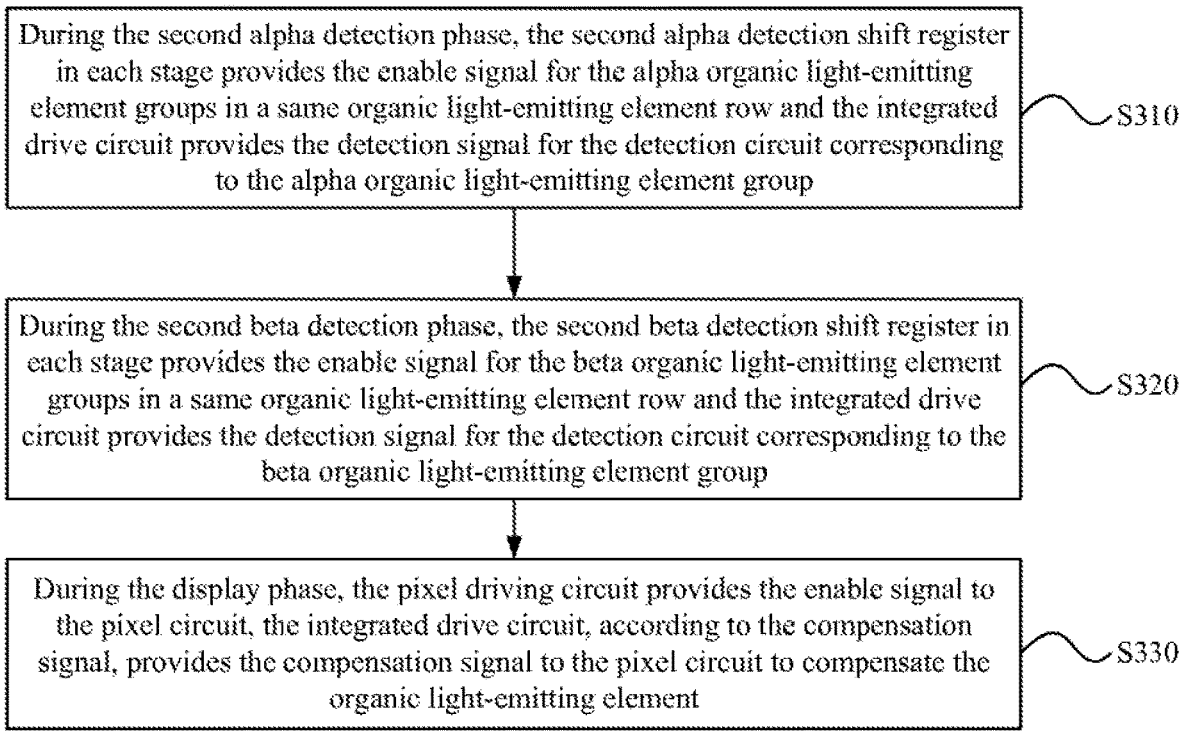
FIG. 15 is a flowchart of a compensation method of another display panel according to an embodiment of the present disclosure.

In an embodiment, FIG. 15 is a flowchart of another compensation method of a display panel according to an embodiment of the present disclosure. With continued reference to FIG. 6, FIG. 8 and FIG. 9, the detection driving circuit 15 includes the second detection shift register circuit 152. The second detection shift register circuit 152 includes multiple stages of second detection shift registers 1521 which are sequentially arranged in cascade, and the number n of stages of the second detection shift register circuit 152, the number m of the organic light-emitting element rows 111H, and the number k of the organic light-emitting element groups 11 meet n=m*k; the second detection shift register circuit 152 includes at least the second alpha detection shift register circuit 152*a* and the second beta detection shift register circuit 152*b*, the second alpha detection shift register circuit 152*a* includes multiple stages of second detection shift registers 1521*a*, the second beta detection shift register circuit 152*b* includes multiple stages of second beta detection shift registers 1521*b*, and the second alpha detection shift registers 1521*a* and the second beta detection shift registers 1521*b* are sequentially arranged in cyclic cascade; the organic light-emitting element group 111 includes at least the alpha organic light-emitting element group 111*a* and the beta organic light-emitting element group 111*b*. The second alpha detection shift register 1521*a* in each stage is electrically connected to the alpha organic light-emitting element group 111*a* in the same organic light-emitting element row 111H, and the second beta detection shift register 1521*b* in each stage is electrically connected to the beta organic light-emitting element group 111*b* in the same organic light-emitting element row 111H.

The detection phase at least includes multiple second alpha detection phases and multiple second beta detection phases, and the multiple second alpha detection phases and the multiple second beta detection phases are arranged sequentially and cyclically.

Based on the structure of the display panel described above, the compensation method for the display panel provided by the embodiment of the present disclosure may include steps described below.

In S310, during the second alpha detection phase, the second alpha detection shift register in each stage provides the enabling signal for the alpha organic light-emitting element groups in a same organic light-emitting element row and the integrated drive circuit provides the detection signal for the detection circuit corresponding to the alpha organic light-emitting element group.

In S320, during the second beta detection phase, the second beta detection shift register in each stage provides the enabling signal for the beta organic light-emitting element groups in a same organic light-emitting element row and the integrated drive circuit provides the detection signal for the detection circuit corresponding to the beta organic light-emitting element group.

In S330, during the display phase, the pixel driving circuit provides the enabling signal to the pixel circuit, the integrated drive circuit, according to the compensation signal, provides the compensation signal to the pixel circuit to compensate the organic light-emitting element.

In this way, by properly setting the detection driving circuit and the detection timing sequence, and sequentially detecting different organic light-emitting element groups in the same organic light-emitting element row, then the entire detection process of the organic light-emitting element array in the order of the organic light-emitting element rows is completed, thereby ensuring that each organic light-emitting element 1111 in the organic light-emitting element array can acquire the precise compensation signal. In the display phase, the organic light-emitting element 1111 is compensated by the data signal including the compensation signal, thereby ensuring good uniformity of the display effect of the entire display panel.

Figure 16:
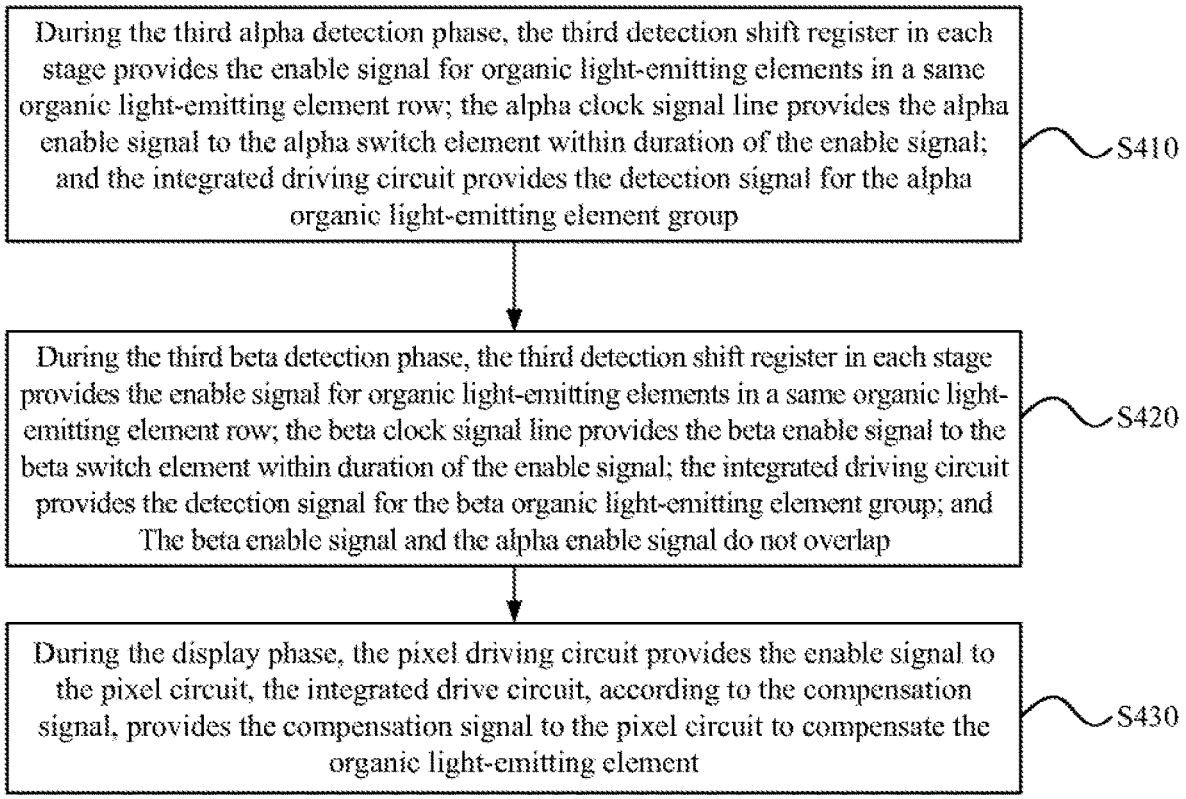
FIG. 16 is a flowchart of a compensation method of another display panel according to an embodiment of the present disclosure.

In an embodiment, FIG. 16 is a flowchart of another compensation method of a display panel according to an embodiment of the present disclosure. With continued reference to FIG. 10, FIG. 11 and FIG. 12, the detection driving circuit 15 includes the third detection shift register circuit 153, the third detection shift register circuit 153 includes multiple stages of third detection shift registers 1531, and the number of stages of the third detection shift register circuit 153 is the same as the number of the organic light-emitting device rows 111H. The display panel 10 further includes a multiple groups of multi-output selection circuits 20 and multiple clock signal lines 21, each group of the multi-output selection circuit 20 includes multiple switch elements 201, and a number of the switch elements 201 in each group of the multi-output selection circuit 20 is the same as the number of the organic light-emitting element groups 111. Each clock signal line 21 is electrically connected to the switch element 201 connected to the same organic light-emitting element group 111.

The organic light0emitting element group 111 includes at least the alpha organic light-emitting element group 111*a* and the beta organic light-emitting element group 111*b*; each group of the multi-output selection circuit 20 includes at least the alpha switch element 201*a* and the beta switch element 201*b*; and the multiple clock signal lines 21 include at least the alpha clock signal line 21*a* and the beta clock signal line 21*b*.

The detection phase includes at least multiple third alpha detection phases and multiple third beta detection phases, and the multiple third alpha detection phases and the multiple third beta detection phases are arranged sequentially and cyclically.

Based on the structure of the display panel described above, the compensation method for the display panel provided by the embodiment of the present disclosure may include steps described below.

In S410, during the third alpha detection phase, the third detection shift register in each stage provides the enabling signal for organic light-emitting elements in a same organic light-emitting element row; the alpha clock signal line provides the alpha enabling signal to the alpha switch element within duration of the enabling signal; and the integrated driving circuit provides the detection signal for the alpha organic light-emitting element group.

In S410, during the third beta detection phase, the third detection shift register in each stage provides the enabling signal for organic light-emitting elements in a same organic light-emitting element row; the beta clock signal line provides the beta enabling signal to the beta switch element within duration of the enabling signal; the integrated driving circuit provides the detection signal for the beta organic light-emitting element group; and The beta enabling signal and the alpha enabling signal do not overlap.

In S430, during the display phase, the pixel driving circuit provides the enabling signal to the pixel circuit, the integrated drive circuit, according to the compensation signal, provides the compensation signal to the pixel circuit to compensate the organic light-emitting element.

In summary, by reasonably setting the detection driving circuit and the detection timing sequence, and sequentially detecting different organic light-emitting element groups in the same organic light-emitting element row 111H, then the entire detection process of the organic light-emitting element array in the order of the organic light-emitting element rows is completed, thereby ensuring that each organic light-emitting element 1111 in the organic light-emitting element array can acquire the precise compensation signal. In the display phase, the organic light-emitting element is compensated by the data signal including the compensation signal, thereby ensuring good uniformity of the display effect of the entire display panel.

Figure 17:
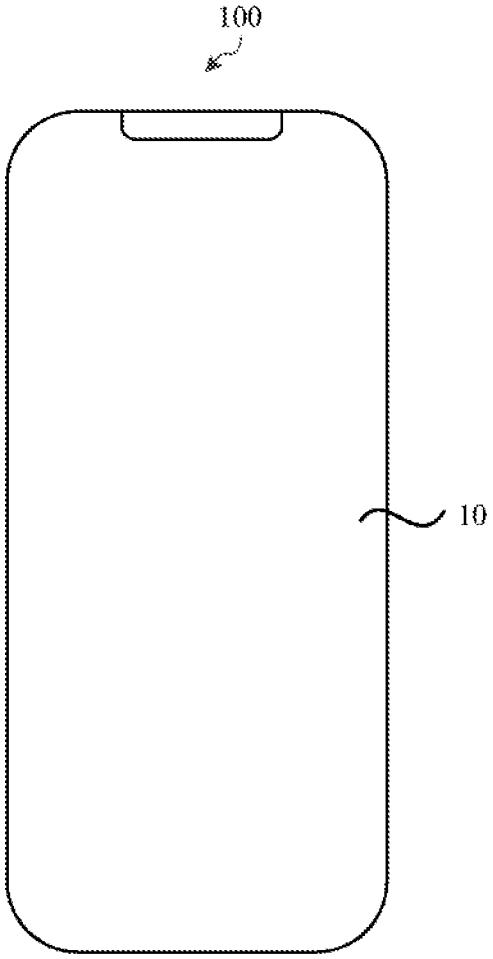
FIG. 17 is a structural diagram of a display device according to an embodiment of the present disclosure.

On the basis of the foregoing embodiments, an embodiment of the present disclosure further provides a display device, including the display panel described by any one embodiment of the present disclosure. Specifically, FIG. 17 is a structural diagram of a display device according to an embodiment of the present disclosure. Referring to FIG. 17, the display device 100 includes a display panel 10 according to the embodiment described above. Exemplarily, the display device 100 may be an electronic device such as a mobile phone, a computer, a smart wearable device (such as, a smart watch), a vehicle-mounted display device and the like, which is not limited in the present disclosure.

It is to be noted that the above are only some embodiments of the present disclosure and the technical principles used therein. It will be understood by those skilled in the art that the present disclosure is not limited to the specific embodiments described herein, and that the features of the various embodiments of the present disclosure may be coupled or combined in part or in whole with one another, and may be collaborated with one another and technically driven in various ways. Those skilled in the art can make various apparent modifications, adaptations, combinations and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A display panel, comprising a display region and a peripheral circuit region surrounding the display region, wherein the display region comprises:

an organic light-emitting element array comprising a plurality of organic light-emitting element groups, each comprising a plurality of organic light-emitting element columns arranged in parallel and numbered as ith, wherein i is an integer larger than 1, wherein ith organic light-emitting element columns of the plurality of organic light-emitting element groups are arranged adjacently; and a pixel circuit and a detection circuit, which are connecting to each of the organic light-emitting element groups in the organic light-emitting element array, wherein the peripheral circuit region comprises a pixel driving circuit, a detection driving circuit, and an integrated driving circuit, the pixel driving circuit is connected to the pixel circuit, the detection driving circuit is connected to the detection circuit, and the integrated driving circuit is respectively connected to the pixel circuit and the detection circuit, wherein in a detection phase, the pixel driving circuit provides a non-enabling signal to the pixel circuit, the detection driving circuit provides an enabling signal to the detection circuit, and the integrated driving circuit provides a detection signal to the detection circuit, sequentially detects the plurality of organic light-emitting element groups in a same organic light-emitting element row and acquires a compensation signal for one of the organic light-emitting elements, wherein in a display phase, the pixel driving circuit provides another enabling signal to the pixel circuit, and the integrated driving circuit provides a compensation signal to the pixel circuit to compensate the organic light-emitting element, wherein the detection driving circuit comprises one of:

a plurality of first detection shift register circuits, wherein the plurality of first detection shift register circuits is in a one-to-one correspondence with the plurality of organic light-emitting element groups;

a second detection shift register circuit; and a plurality of third detection shift register circuits each comprising a plurality of stages of the plurality of third detection shift registers, the stages are sequentially arranged in a cascade mode, and a number of the stages of the third detection shift register circuits is the same as a number of the organic light-emitting element rows, wherein in a case where the detection driving circuit comprises a plurality of first detection shift register circuits, each of the first detection shift register circuits comprises a plurality of first detection shift registers sequentially arranged in cascade mode, a number of stages of the plurality of first detection shift registers is a same as a number of organic light-emitting element rows, and a first detection shift register in each state is electrically connected to a detection circuit corresponding to a plurality of organic light-emitting elements in a same organic light-emitting element group arranged in a same row, and the display panel further comprises a plurality of detection signal lines, one end of a jth detection signal line among the plurality of detection signal lines is electrically connected to the integrated driving circuit, and another end of the jth detection signal line is electrically connected to a detection circuit corresponding to a jth organic light-emitting element row in each of the organic light-emitting element group, wherein $j \geq 1$ and j is an integer, wherein in a case where the detection driving circuit comprises a second detection shift register circuit, the second detection shift register circuit comprises a plurality of second detection shift registers sequentially arranged in cascade, and a relationship of a number n of the stages of the second detection shift register circuits, a number m of the organic light-emitting element rows and a number k of the organic light-emitting element groups meet $n=m*k$, wherein n, m and $k \geq 1$ and n, m and k are integers, the detection circuits corresponding to the organic light-emitting elements in a plurality of organic light-emitting element groups in a same organic light-emitting element row are respectively and electrically connected to a plurality of stages of the second detection shift registers which are arranged nearby, and the display panel further comprises a plurality of detection signal lines, one end of a jth detection signal line among the plurality of detection signal lines is electrically connected to the integrated driving circuit, and another end of the jth detection signal line is electrically connected to a detection circuit corresponding to a jth organic light-emitting element row in each of the organic light-emitting element groups, wherein j is an integer and $j \geq 1$, and wherein in a case where the detection driving circuit comprises a plurality of third detection shift register circuits, the third detection shift registers in each stage each is electrically connected to a detection circuit corresponding to the organic light-emitting elements in a same organic light-emitting element row, the display panel further comprises a plurality of groups of multi-output selection circuits and a plurality of clock signal lines, each group of the multi-output selection circuits among the plurality of groups of multi-output selection circuits comprises a plurality of switch elements, a number of the switch elements in the each group of multi-output selection circuits is a same as a number of the organic light-emitting element groups, and each clock signal line is electrically connected to a switch element connected to a same organic light-emitting element group, and the display panel further comprises a plurality of detection signal lines, one end of each of the plurality of detection signal lines is electrically connected to the integrated driving circuit, another end of each of the detection signal lines is electrically connected to a signal input terminal of the each group of multi-output selection circuits, and a signal output terminal of the each group of multi-output selection circuits is connected to one organic light-emitting element row through the switch element.

2. The display panel of claim 1, wherein each of the first detection shift register circuits comprises at least a first alpha detection shift register circuit and a first beta detection shift register circuit, at least one of the plurality of organic light-emitting element groups comprises an alpha organic light-emitting element group and a beta organic light-emitting element group, and the first alpha detection shift register circuit is electrically connected to the alpha organic light-emitting element group, and the first beta detection shift register circuit is electrically connected to the beta organic light-emitting element group, wherein the detection phase at least comprises a first alpha detection phase arranged sequentially with a first beta detection phase, wherein in the first alpha detection phase, the first alpha detection shift register provides an enabling signal for a detection circuit corresponding to the alpha organic light-emitting element group, and the integrated driving circuit provides a detection signal for a detection circuit corresponding to the alpha organic light-emitting element group, and wherein in the first beta detection phase, the first beta detection shift register circuit provides an enabling signal for a detection circuit corresponding to the beta organic light-emitting element group, and the integrated driving circuit provides a detection signal for a detection circuit corresponding to the beta organic light-emitting element group.

3. The display panel of claim 1, wherein the second detection shift register circuit comprises at least a second alpha detection shift register circuit and a second beta shift register circuit, wherein the second alpha detection shift register circuit comprises a plurality of stages of the second alpha detection shift registers, the second beta shift register circuit comprises a plurality of stages of the second beta detection shift registers, and wherein the second alpha detection shift registers and the second beta shift registers are sequentially arranged in cyclic cascade mode, wherein the organic light-emitting element group comprises at least an alpha organic light-emitting element group and a beta organic light-emitting element group, the second beta detection shift register in each stage is electrically connected to the beta organic light-emitting element group in a same organic light-emitting element row, and the second beta detection shift register in each stage is electrically connected to the beta organic light-emitting element group in a same organic light-emitting element row, wherein the detection phase at least comprises a plurality of second alpha detection phases and a plurality of second beta detection phases, and the plurality of second alpha detection phases and the plurality of second beta detection phases are arranged sequentially and cyclically, wherein in the second alpha detection phase, the second alpha detection shift register in each stage provides an enabling signal to the alpha organic light-emitting element group in a same organic light-emitting element row, and the integrated driving circuit provides a detection signal for a detection circuit corresponding to the alpha organic light-emitting element group, and wherein in the second beta detection phase, the second beta detection shift register in each stage provides an enabling signal to the beta organic light-emitting element group in a same organic light-emitting element row, and the integrated driving circuit provides a detection signal for a detection circuit corresponding to the beta organic light-emitting element group.

4. The display panel of claim 1, wherein the organic light-emitting element group includes at least an alpha organic light-emitting element group and a beta organic light-emitting element group, wherein each group of the multi-output selection circuits at least comprises an alpha switch element and a beta switch element, and the plurality of clock signal lines at least comprises an alpha clock signal line and a beta clock signal line, wherein the detection phase at least comprises a plurality of third alpha detection phases and a plurality of third beta detection phases, and the plurality of third alpha detection phases and the plurality of second beta detection phases are arranged sequentially and cyclically, wherein in each third alpha detection phase, the third detection shift register in each stage provides an enabling signal for organic light-emitting elements in a same organic light-emitting element row, the alpha clock signal line provides an alpha enabling signal to the alpha switch element within a duration of the enabling signal, and the integrated driving circuit provides a detection signal to the alpha organic light-emitting element group, and wherein in each third beta detection phase, the third detection shift register in each stage provides an enabling signal for organic light-emitting elements in a same organic light-emitting element row, the beta clock signal line provides an beta enabling signal to the beta switch element in a duration of the enabling signal, the integrated driving circuit provides a detection signal to the beta organic light-emitting element group, and the beta enabling signal and the alpha enabling signal do not overlap.

5. The display panel of claim 1, wherein, in part of the display phase, the detection driving circuit provides an enabling signal to the detection circuit and the integrated driving circuit provides a reset signal to the detection circuit.

6. The display panel of claim 1, wherein the detection phase comprises a first detection phase and a second detection phase, wherein in the first detection phase, the integrated driving circuit provides a reset signal to the detection circuit, and wherein in the second detection phase, the integrated driving circuit provides a detection signal to the detection circuit.

7. The display panel of claim 1, wherein the detection circuit comprises a thin film transistor, and wherein a gate of the thin film transistor is electrically connected to the detection driving circuit, a first electrode of the thin film transistor is electrically connected to the integrated driving circuit, and a second electrode of the thin film transistor is electrically connected to the organic light-emitting element.

8. A display device, comprising a display panel, wherein the display panel comprises a display region and a peripheral circuit region surrounding the display region, wherein the display region comprises:

an organic light-emitting element array comprising a plurality of organic light-emitting element groups, each comprising a plurality of organic light-emitting element columns arranged in parallel and numbered as ith, and wherein i is an integer larger than 1, and wherein ith organic light-emitting element columns of the plurality of organic light-emitting element groups are arranged adjacently; and a pixel circuit and a detection circuit which are connecting to each of the organic light-emitting element groups in the organic light-emitting element array, wherein the peripheral circuit region comprises a pixel driving circuit, a detection driving circuit, and an integrated driving circuit, the pixel driving circuit is connected to the pixel circuit, the detection driving circuit is connected to the detection circuit, and the integrated driving circuit is respectively connected to the pixel circuit and the detection circuit, wherein in a detection phase, the pixel driving circuit provides a non-enabling signal to the pixel circuit, the detection driving circuit provides an enabling signal to the detection circuit, and the integrated driving circuit provides a detection signal to the detection circuit, sequentially detects the plurality of organic light-emitting element groups in a same organic light-emitting element row and acquires a compensation signal for one of the organic light-emitting elements, wherein in a display phase, the pixel driving circuit provides another enabling signal to the pixel circuit, and the integrated driving circuit provides a compensation signal to the pixel circuit to compensate the organic light-emitting element, wherein the detection driving circuit comprises a plurality of first detection shift register circuits, and the plurality of first detection shift register circuits is in a one-to-one correspondence with the plurality of organic light-emitting element groups, wherein each of the first detection shift register circuits comprises a plurality of first detection shift registers sequentially arranged in cascade mode, and a number of stages of the plurality of first detection shift registers is a same as a number of organic light-emitting element rows, and a first detection shift register in each state is electrically connected to a detection circuit corresponding to a plurality of organic light-emitting elements in a same organic light-emitting element group arranged in a same row, and wherein the display panel further comprises a plurality of detection signal lines, one end of a jth detection signal line among the plurality of detection signal lines is electrically connected to the integrated driving circuit, and another end of the jth detection signal line is electrically connected to a detection circuit corresponding to a jth organic light-emitting element row in each of the organic light-emitting element group, wherein $j \geq 1$ and j is an integer.

9. A compensation method for a display panel, wherein the display panel comprises a display region and a peripheral circuit region surrounding the display region, the display region comprising:

an organic light-emitting element array comprising a plurality of organic light-emitting element groups, each comprising a plurality of organic light-emitting element columns arranged in parallel and numbered as ith, wherein i is an integer larger than 1, and ith organic light-emitting element columns of the plurality of organic light-emitting element groups are arranged adjacently; and a pixel circuit and a detection circuit which are connecting to each of the organic light-emitting element groups in the organic light-emitting element array, wherein the peripheral circuit region comprises a pixel driving circuit, a detection driving circuit, and an integrated driving circuit, the pixel driving circuit is connected to the pixel circuit, the detection driving circuit is connected to the detection circuit, and the integrated driving circuit is respectively connected to the pixel circuit and the detection circuit, wherein in a detection phase, the pixel driving circuit provides a non-enabling signal to the pixel circuit, the detection driving circuit provides an enabling signal to the detection circuit, and the integrated driving circuit provides a detection signal to the detection circuit, sequentially detects the plurality of organic light-emitting element groups in a same organic light-emitting element row and acquires a compensation signal for one of the organic light-emitting element, and wherein in a display phase, the pixel driving circuit provides another enabling signal to the pixel circuit, the integrated driving circuit provides a compensation signal to the pixel circuit to compensate the organic light-emitting element, the compensation method comprising:

in the detection phase, by using the pixel driving circuit, providing a non-enabling signal to the pixel circuit, by using the detection driving circuit, providing an enabling signal to the detection circuit, and by using the integrated driving circuit, providing a detection signal to the detection circuit, sequentially detecting the plurality of organic light-emitting element groups in a same organic light-emitting element row, and acquiring a compensation signal for the organic light-emitting element; and in the display phase, by using the pixel driving circuit, providing an enabling signal to the pixel circuit, and by using the integrated driving circuit, providing a compensation signal to the pixel circuit to compensate the organic light-emitting element, wherein the detection driving circuit comprises one of:

a plurality of first detection shift register circuits, wherein the plurality of first detection shift register circuits is in a one-to-one correspondence with the organic light-emitting element groups;

a second detection shift register circuit, comprising a plurality of stages of second detection shift registers sequentially arranged in a cascade mode, and a relationship of a number n of stages of the second detection shift register circuits, a number m of the organic light-emitting element rows and a number k of the organic light-emitting element groups meets $n=m*k$, wherein n, m and $k \geq 1$ and n, m and k are integers; and a plurality of third detection shift register circuits, wherein each of the plurality of third detection shift register circuits comprises a plurality of stages of third detection shift registers sequentially arranged in a cascade mode, and a number of stages of the third detection shift register circuits is the same as a number of organic light-emitting element rows, wherein in a case where the detection driving circuit comprises a plurality of first detection shift register circuits, each of the first detection shift register circuits comprises a plurality of stages of first detection shift registers which are sequentially arranged in a cascade mode, and a number of stages of the first detection shift register circuits is a same as a number of organic light-emitting element rows, each of the first detection shift register circuits at least comprises a first alpha detection shift register circuit and a first beta detection shift register circuit, and the organic light-emitting element group comprises an alpha organic light-emitting element group and a beta organic light-emitting element group, the detection phase at least comprises a first alpha detection phase arranged sequentially with a first beta detection phase, in the detection phase, by using the detection driving circuit, providing the enabling signal to the detection circuit, and by using the integrated driving circuit, providing the detection signal to the detection circuit comprise:

the first alpha detection phase, by using the first alpha detection shift register circuit, providing the enabling signal for a detection circuit corresponding to the alpha organic light-emitting element group, and by using the integrated driving circuit, providing the detection signal for a detection circuit corresponding to the first alpha organic light-emitting element group; and in the first beta detection phase, by using the first beta detection shift register circuit, providing an enabling signal for the detection circuit corresponding to the beta organic light-emitting element group, and by using the integrated driving circuit, providing the detection signal for a detection circuit corresponding to the first beta organic light-emitting element group, wherein in a case where the detection driving circuit comprises a second detection shift register circuit, the second detection shift register circuit at least comprises a second alpha detection shift register circuit and a second beta detection shift register circuit, the second alpha detection shift register circuit comprises a plurality of stages of second alpha detection shift registers, the second beta detection shift register circuit comprises a plurality of stages of second beta detection shift registers, the second alpha detection shift registers and the second beta detection shift registers are sequentially arranged in a cyclic cascade mode, and the organic light-emitting element group at least comprises an alpha organic light-emitting element group and a beta organic light-emitting element group, the detection phase at least comprises a plurality of second alpha detection phases and a plurality of second beta detection phases, and the plurality of second alpha detection phases and the plurality of second beta detection phases are arranged sequentially and cyclically, in the detection phase, by using the detection driving circuit providing the enabling signal to the detection circuit, and by using the integrated driving circuit, providing the detection signal to the detection circuit comprise:

in the second alpha detection phase, by using the second alpha detection shift register in each stage, providing the enabling signal for the alpha organic light-emitting element group in a same organic light-emitting element row, and by using the integrated driving circuit, providing the detection signal for a detection circuit corresponding to the alpha organic light-emitting element group; and in the second beta detection phase, by using the second beta detection shift register in each stage, providing the enabling signal for the beta organic light-emitting element group in a same organic light-emitting element row, and by using the integrated driving circuit, providing the detection signal for a detection circuit corresponding to the beta organic light-emitting element group, or wherein in a case where the detection driving circuit comprises a plurality of third detection shift register circuits, the display panel further comprises a plurality of groups of multi-output selection circuits and a plurality of clock signal lines, each of the plurality of groups of multi-output selection circuits comprises a plurality of switch elements, and a number of the switch elements in the each group of multi-output selection circuits is the same as a number of the organic light-emitting element groups, and each clock signal line is electrically connected to a switch element connected to a same organic light-emitting element group, the organic light-emitting element group at least comprises an alpha organic light-emitting element group and a beta organic light-emitting element group, each group of the multi-output selection circuits at least comprises an alpha switch element and a beta switch element, and the plurality of clock signal lines at least comprises an alpha clock signal line and a beta clock signal line, the detection phase at least comprises a plurality of third alpha detection phases and a plurality of third beta detection phases, and the plurality of third alpha detection phases and the plurality of second beta detection phases are arranged sequentially and cyclically, in the detection phase, by using the detection driving circuit, providing the enabling signal to the detection circuit, and by using the integrated driving circuit, providing the detection signal to the detection circuit comprise:

in the third alpha detection phase, by using the third detection shift register in each stage, providing the enabling signal for organic light-emitting elements in a same organic light-emitting element row, by using the alpha clock signal line, providing the alpha enabling signal to the alpha switch element within duration of the enabling signal, and by using the integrated driving circuit, providing the detection signal for the alpha organic light-emitting element group;

in the third beta detection phase, by using the third detection shift register in each stage, providing the enabling signal for organic light-emitting elements in a same organic light-emitting element row, by using the beta clock signal line, providing the beta enabling signal to the beta switch element within duration of the enabling signal, and by using the integrated driving circuit, providing the detection signal for the beta organic light-emitting element group, and the beta enabling signal and the alpha enabling signal do not overlap.

* * * * *